US005901520A

United States Patent [19]

Abdul-Baki

[11] Patent Number: 5,901,520

[45] Date of Patent: May 11, 1999

[54] INTERLOCKING BUILDING BLOCKS

[76] Inventor: Assad Abdul-Baki, 2111 Jefferson Davis Hwy. Apt. 916N, Arlington, Va. 22202

[21] Appl. No.: 08/500,829

[22] Filed: Jul. 11, 1995

[51] Int. Cl.[6] ..... E04B 2/00

[52] U.S. Cl. ..... 52/592.6; 52/569; 52/570; 52/421; 52/424; 52/604; 52/607; 52/610; 52/611

[58] Field of Search ..... 52/592.6, 603–612, 52/569–572, 421, 422, 424

[56] References Cited

U.S. PATENT DOCUMENTS

| | | | |
|---|---|---|---|
| 952,080 | 3/1910 | McIntyre | 52/605 |
| 3,764,357 | 10/1973 | Bowles et al. . | |
| 3,936,987 | 2/1976 | Calvin . | |
| 4,001,988 | 1/1977 | Riefler . | |
| 4,016,693 | 4/1977 | Warren . | |
| 4,098,040 | 7/1978 | Riefler . | |
| 4,268,317 | 5/1981 | Rayl . | |
| 4,314,431 | 2/1982 | Rabassa . | |
| 4,372,091 | 2/1983 | Brown et al. . | |
| 4,439,967 | 4/1984 | Dielenberg | 52/241 X |
| 4,473,985 | 10/1984 | Hunt | 52/570 X |
| 4,490,075 | 12/1984 | Risi et al. . | |
| 4,787,189 | 11/1988 | Haug et al. | 52/606 X |
| 4,854,103 | 8/1989 | Klym | 52/592.6 |
| 4,860,515 | 8/1989 | Browning | 52/422 X |
| 4,905,439 | 3/1990 | Filteau . | |
| 4,982,544 | 1/1991 | Smith | 52/606 |
| 5,230,194 | 7/1993 | McClure | 52/606 X |
| 5,379,565 | 1/1995 | Vienne | 52/605 X |
| 5,457,926 | 10/1995 | Jensen | 52/604 |

FOREIGN PATENT DOCUMENTS

| | | | |
|---|---|---|---|
| 0518059 | 3/1953 | Belgium | 52/421 |
| 2150874 | 4/1973 | Germany | 52/592.6 |
| 0461566 | 9/1951 | Italy | 52/606 |
| 0031772 | 2/1921 | Norway | 52/592.6 |

*Primary Examiner*—Robert Canfield
*Attorney, Agent, or Firm*—Hazel & Thomas, P.C.

[57] ABSTRACT

Interlocking blocks are provided which are light in weight, and which may be assembled without use of mortar or other binding agent. Because the interlocking block is light in weight, it may be of a larger size than conventional blocks. Each interlocking block employs a number of projections and corresponding notches positioned and dimensioned to couple with adjacent interlocking block's projections and corresponding notches. A series of such interlocking blocks may then be assembled to form gravity retaining walls or any other rigid structures. The interlocking blocks are structurally strong enough to be used as form-work and may also be filled with insulating material, sound-proofing material, reinforcing material or any other advantageous material. The interlocking blocks may also be quickly assembled or disassembled in individualized constructions, may be pre-assembled into wall sections on or off a construction site.

28 Claims, 15 Drawing Sheets

FIG. 16
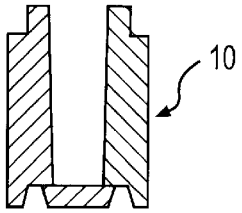
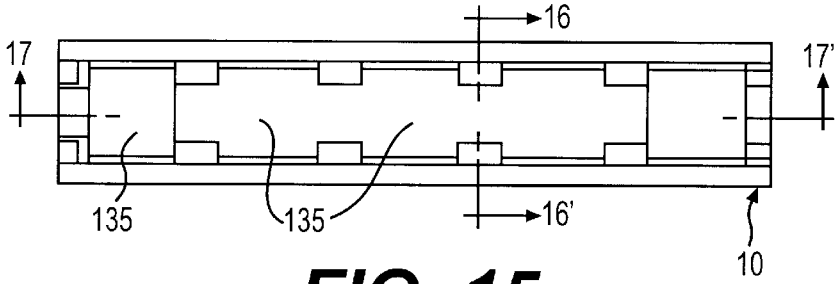
FIG. 15
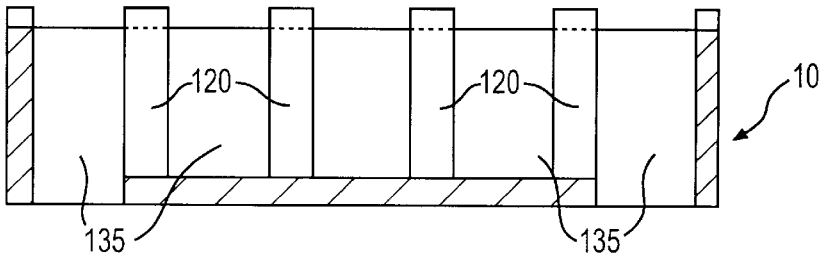
FIG. 17
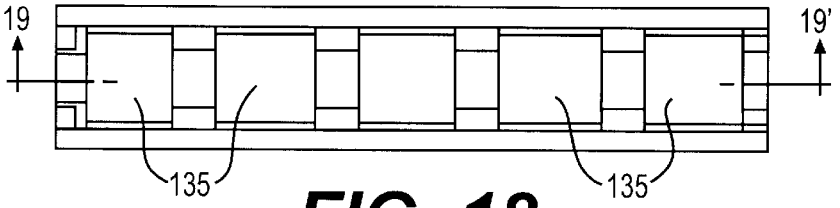
FIG. 18
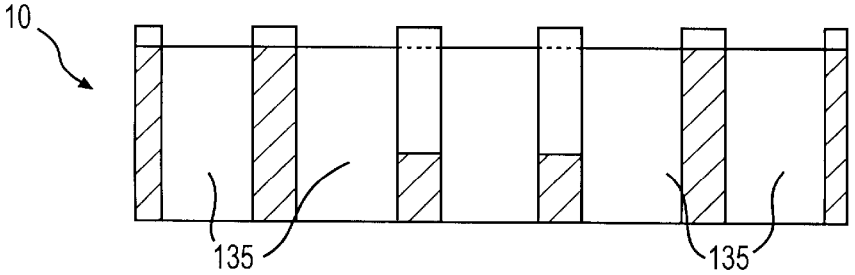
FIG. 19

INTERLOCKING BUILDING BLOCKS

BACKGROUND OF THE INVENTION

1. Field of the Invention

The present invention relates generally to structural concrete building blocks. More particularly, the present invention relates to molded light weight large concrete blocks used for constructing external walls and retaining walls as well as form-work in load bearing walls and that is easily reinforced in horizontal and vertical directions.

2. Description of the Prior Art

Concrete blocks used for constructing walls generally require mortar to adhere one block to another. Consequently, walls and other structures assembled from conventional blocks are often expensive and labor intensive to build and maintain. Additionally, conventional blocks may not be used for form work.

In order to eliminate the use of mortar, self linking blocks have been constructed utilizing different systems of interconnecting tongues and grooves. Such interconnecting blocks are generally of limited size and are generally too heavy to be of practical use. Additionally, presently available interconnecting blocks often have poor thermal insulation properties, are not sufficiently strong to be used as form-work and do not have internal cavities designed to facilitate the placement of insulation, reinforcing members, pipes or conduits.

In an effort to create interconnecting blocks that are lightweight and have high thermal resistivity, some presently available interconnecting blocks are constructed from polystyrene. However, polystyrene is flammable, emits toxic vapors and is expensive to transport. Additionally, polystyrene is often not receptive to finishing with plaster or gypsum and the blocks must often be treated with bonding agents prior to finishing. These disadvantages render presently available interconnecting blocks impractical for many applications.

For example, a system marketed under trademark MEP consists of a polystyrene panel reinforced with wire mesh trusses spaced 6" on center and with wire mesh reinforcement on the two faces of the polystyrene panel. The external faces are covered by a plaster layer ⅞" thick. The MEP provides a highly insulated wall that is structurally strong and can be easily constructed. However, it has a few drawbacks. It limits the work to only external walls in building construction, and it is not a cheap alternative.

Consequently, a need exists for lightweight building blocks that have high thermal insulating properties, and strong construction, that do not give off toxic fumes, and that incorporate internal cavities.

Several U.S. patents disclose modular building blocks. These include U.S. Pat. Nos. 3,764,357; 3,936,987; 4,001,988; 4,016,693; 4,098,040; 4,268,317; 4,314,431; 4,372,091; 4,490,075; and 4,905,439.

SUMMARY OF THE INVENTION

It is the object of the present invention to provide non-flammable, lightweight, interlocking self-aligning blocks for use in constructing external walls, load bearing walls, retaining walls and sound absorbing walls.

It is another object of this invention to provide interlocking, self-aligning blocks useable as permanent form-work in external, load bearing and retaining walls, wherein the blocks incorporate polystyrene beads as a lightweight aggregate that enhance the thermal resistivity and sound absorption of the blocks.

It is another object of this invention to provide blocks that are open in vertical and horizontal directions for placing reinforcement structures and facilitating concrete flow within the wall.

It is another object of this invention to provide blocks that are strong enough to sustain large horizontal and vertical pressures, usable as form-work and easily cut into desired dimensions.

It is another object of this invention to provide blocks which may facilitate partially pre-casting interconnecting walls.

It is another object of this invention to provide interlocking blocks forming a wall that facilitates the easy installation of pipes and electrical conduits.

It is the object of the present invention to provide a block that has interlocking features that make the block easy to assemble and self-aligning in the vertical and longitudinal directions with other blocks.

It is another object of this invention to provide a lightweight cementations block having a size 2.5 to 3.25 times the size of an ordinary cement block, while its weight is equal to that of an ordinary cement block.

It is yet another object of this invention to provide a block with enough insulation. This properly is accomplished by replacing most of the regular aggregates by polystyrene beads in the ratio of 50 to 70% by volume. In case more insulation is needed, the internal compartments of the block can be filled with cellular or light weight concrete.

It is another object of this invention to provide a block that is open in the vertical and the horizontal directions to allow the easy placement of reinforcement and to allow concrete to flow easily in the built wall, thus creating a monolithic wall slab.

It is another object of this invention to provide a block having enough strength to sustain the horizontal pressure developed by green concrete. With such strength accomplished by having a rich mix reinforced with Composite Reinforcing Elements, steel fibers or steel wires, the block plays the role of a permanent form-work. Having the strength and the continuously opened compartments, the block becomes an ideal, cheap form-work, with inherently diversified applications in the construction of all types of walls.

It is another object of this invention to provide a block when built as a wall, a partially pre-cast wall panel can be fabricated in the cheapest and fastest method. Such wall can be lifted and placed in position where remaining compartments can be concreted in situ thus creating a continuity with the rest of the structure. This partially pre-cast wall has a weight at least two and a half times less than an ordinary similar pre-cast concrete wall.

It is another object of this invention to provide block that has a good damping and noise absorbing properties.

It is another object of this invention to provide a block that can be cut very easily and neatly with a saw.

It is another object of this invention to provide a lintel form-work that can be reinforced as a beam and filled with concrete in situ without needing to be propped. Moreover the lintel has along its upper face the standard protrusions which interlock very firmly with blocks resting on top of the lintel.

It is another object of this invention to provide a block that reduces the dead weight of the walls by 30 to 50%.

In a preferred embodiment, a composite structural unit for use in the construction of walls and the like in a vertically stacked horizontal row relationship with other similar units. The composite structural unit comprises: a pair of laterally spaced longitudinally extending and vertically disposed side panels, each of a generally rectangular configuration viewed laterally and each of generally a rectangular cross-section, the panels cooperatively defining a vertical exposed generally rectangular space therebetween; and a pair of vertically disposed generally "U" shaped and laterally extending connecting arms disposed at a proximal and distal end of the rectangular space and between the panels at respective inner surface thereof whereby to secure the panels in relatively fixed position, the connecting arms including a top-bottom interlocking means comprising a tapered projection disposed at each end of the "U" shaped connecting arm and a cooperating tapered notch disposed on a lower surface of each connecting arm; the tapered projection and notch arranged in a vertically opposite relationship to the connecting arm, the tapered projections having at least three surfaces for pressure engagement without mortar, and the tapered notch on each connecting arm cooperating with the tapered portions on a connecting arm of an immediately sub-adjacent unit for laterally and transversely interlocking the two units when the units are superimposed, the interlocking means being gravity dependent, the "U" shaped arm allowing fluid communication between an immediately horizontally sub-adjacent unit. In an alternate embodiment, a composite structural unit for use in construction of walls and the like in a vertically stacked horizontal row relationship with other similar units. The composite structural unit comprises: a first pair of laterally spaced longitudinally extending and vertically disposed side panels, each of a generally rectangular configuration viewed laterally and each of generally a rectangular cross-section, the panels cooperatively defining a first vertical exposed generally rectangular space therebetween; a first pair of vertically disposed generally "U" shaped and laterally extending connecting arms disposed at a proximal and distal end of the first rectangular space and between the first panels at respective inner surface thereof whereby to secure the first panels in relatively fixed position, the first connecting arms including a top-bottom interlocking means comprising a tapered projection disposed at each end of the "U" shaped connecting arm and a cooperating tapered notch disposed on a lower surface of each connecting arm; the tapered projection and notch arranged in a vertically opposite relationship to the connecting arm, the tapered projections having at least three surfaces for pressure engagement without mortar, and the tapered notch on each connecting arm cooperating with the tapered portions on a connecting arm of an immediately sub-adjacent unit for laterally and transversely interlocking the two units when the units are superimposed, the interlocking means being gravity dependent, the "U" shaped arm allowing fluid communication between an immediately horizontally sub-adjacent unit; a second pair of laterally spaced longitudinally extending and vertically disposed side panels, each of a generally rectangular configuration viewed laterally and each of generally a rectangular cross-section, the panels cooperatively defining a second vertical exposed generally rectangular space therebetween and disposed perpendicular to the first pair of side panels in a "T" fashion; a second pair of vertically disposed generally "U" shaped and laterally extending connecting arms disposed at a proximal and distal end of the second rectangular space and between the second panels at respective inner surface thereof whereby to secure the second panels in relatively fixed position, the second connecting arms including a top-bottom interlocking means comprising a tapered projection disposed at each end of the "U" shaped connecting arm and a cooperating tapered notch disposed on a lower surface of each connecting arm; the tapered projection and notch arranged in a vertically opposite relationship to the connecting arm, the tapered projections having at least three surfaces for pressure engagement without mortar, and the tapered notch on each connecting arm cooperating with the tapered portions on a connecting arm of an immediately sub-adjacent unit for laterally and transversely interlocking the two units when the units are superimposed, the interlocking means being gravity dependent, the "U" shaped arm allowing fluid communication between an immediately horizontally sub-adjacent unit.

In another alternate embodiment, a composite structural unit for use in construction of walls and the like in a vertically stacked horizontal row relationship with other similar units. The composite structural unit comprises: a first pair of laterally spaced longitudinally extending and vertically disposed side panels, each of a generally rectangular configuration viewed laterally and each of generally a rectangular cross-section, the panels cooperatively defining a first vertical exposed generally rectangular space therebetween; a first pair of vertically disposed generally "U" shaped and laterally extending connecting arms disposed at a proximal and distal end of the first rectangular space and between the first panels at respective inner surface thereof whereby to secure the first panels in relatively fixed position, the first connecting arms including a top-bottom interlocking means comprising a tapered projection disposed at each end of the "U" shaped connecting arm and a cooperating tapered notch disposed on a lower surface of each connecting arm; the tapered projection and notch arranged in a vertically opposite relationship to the connecting arm, the tapered projections having at least three surfaces for pressure engagement without mortar, and the tapered notch on each connecting arm cooperating with the tapered portions on a connecting arm of an immediately sub-adjacent unit for laterally and transversely interlocking the two units when the units are superimposed, the interlocking means being gravity dependent, the "U" shaped arm allowing fluid communication between an immediately horizontally sub-adjacent unit; a second pair of laterally spaced longitudinally extending and vertically disposed side panels, each of a generally rectangular configuration viewed laterally and each of generally a rectangular cross-section, the panels cooperatively defining a second vertical exposed generally rectangular space therebetween and disposed perpendicular to the first pair of side panels in an "L" fashion; a second pair of vertically disposed generally "U" shaped and laterally extending connecting arms disposed at a proximal and distal end of the second rectangular space and between the second panels at respective inner surface thereof whereby to secure the second panels in relatively fixed position, the second connecting arms including a top-bottom interlocking means comprising a tapered projection disposed at each end of the "U" shaped connecting arm and a cooperating tapered notch disposed on a lower surface of each connecting arm; the tapered projection and notch arranged in a vertically opposite relationship to the connecting arm, the tapered projections having at least three surfaces for pressure engagement without mortar, and the tapered notch on each connecting arm cooperating with the tapered portions on a connecting arm of an immediately sub-adjacent unit for laterally and transversely interlocking the two units when the units are superimposed, the interlocking means being gravity dependent, the "U" shaped arm allowing fluid communication between an immediately horizontally sub-adjacent unit, except for one of the second pair of connecting arms being solid and thus preventing flow in one direction.

Other objects and features of the present invention will be apparent from the following detailed description of the preferred embodiment.

BRIEF DESCRIPTION OF THE DRAWINGS

The invention will be further described in conjunction with the accompanying drawings, in which:

FIG. 15 is a top view of a lintel constructed in accordance with a preferred embodiment of the invention;

FIG. 16 is a cross-sectional view of a lintel taken along lines 16–16' of FIG. 15;

FIG. 17 is a longitudinal cross-sectional view of a lintel taken along lines 17–17' of FIG. 15;

FIG. 18 is a top view of a straight interlocking block used in a partially pre-cast wall constructed in accordance with a preferred embodiment of the invention;

FIG. 19 is a sectional view taken along lines 19–19' of FIG. 18;

DETAILED DESCRIPTION OF THE PREFERRED EMBODIMENT

Pursuant to the present invention, interlocking blocks may generally be formed into any desired shape and size to facilitate construction of buildings, retaining walls or any other rigid structure. Discussed below are the following three representative embodiments: A straight interlocking block; a T-shaped block, and an L-shaped block. These blocks are discussed for illustrative and instructional purposes. It is understood, however, that other interlocking blocks having other shapes and dimensions are contemplated within the scope of this invention.

Straight Interlocking Block

Figure 1:
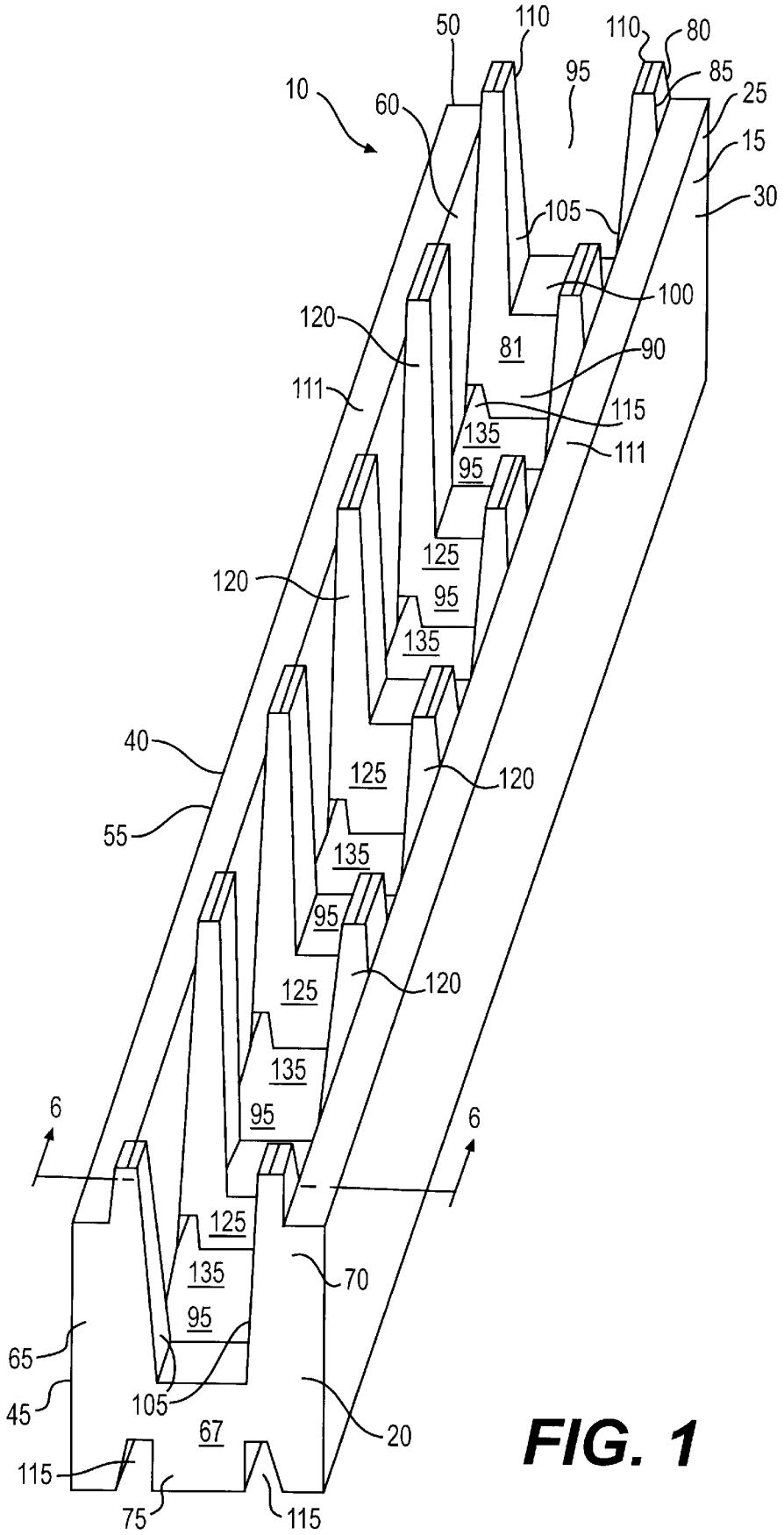
FIG. 1 is an elevational view of an interlocking block constructed in accordance with a preferred embodiment of the invention.
Figure 2:
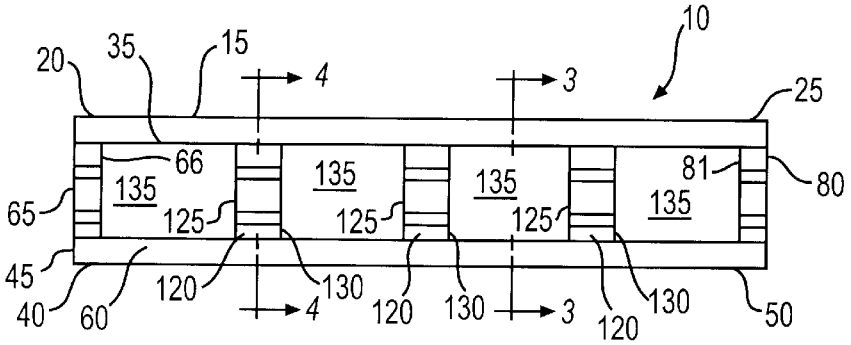
FIG. 2 is a top view of the interlocking block of FIG. 1.

With reference to the Figures, wherein like reference characters indicate like elements throughout the several views and, in particular, with reference to FIG. 1, a straight interlocking block 10 is of a generally rectangular shape and includes a first sidewall 15 having a medial end 20, a distal end 25, an outer surface 30 and an inner surface 35 (FIG. 2). Straight interlocking block 10 also includes a second sidewall 40 having a medial end 45, a distal end 50, an outer surface 55 and an inner surface 60.

First sidewall 15 and second sidewall 40 are rigidly held in opposition by medial end-wall 65 having an inner surface 66 (FIG. 2), an outer surface 67, an upper end 70 and a lower end 75, and distal end-wall 80 having an inner surface 81 (FIG. 2), an upper end 85 and a lower end 90. Medial end-wall 65 and distal end-wall 80 each include a generally U-shaped cavity 95. U-shaped cavity 95 is defined by a bottom surface 100 and opposing sidewall surfaces 105.

In the preferred embodiment, opposing sidewalls 105 slope generally upwardly and outwardly, terminating in projecting portions 110 extending above each upper surface 111 (FIG. 3) of first and second sidewalls 15 and 40 respectively. Preferably, projecting portions 110 taper at an angle of between 3° and 15°, but may slope at an angle of up to 30°. Located in each lower end of medial and distal end-walls 65 and 80 respectively, and positioned opposite each projecting portion 110, is a notch 115 which extends laterally along sidewalls 15 and 40 through partitions 67, 125 and 81. Notch 115 has a depth of slightly greater than the height of each projecting portion 110. It should be appreciated that each notch 115 may be provided as several discrete notches one for each projecting portion 110 but preferably is at least a single notch extending the length between projecting portions of at least one pair of spacers 120 which tapers to cooperate with projecting portions 110.

Figure 6:
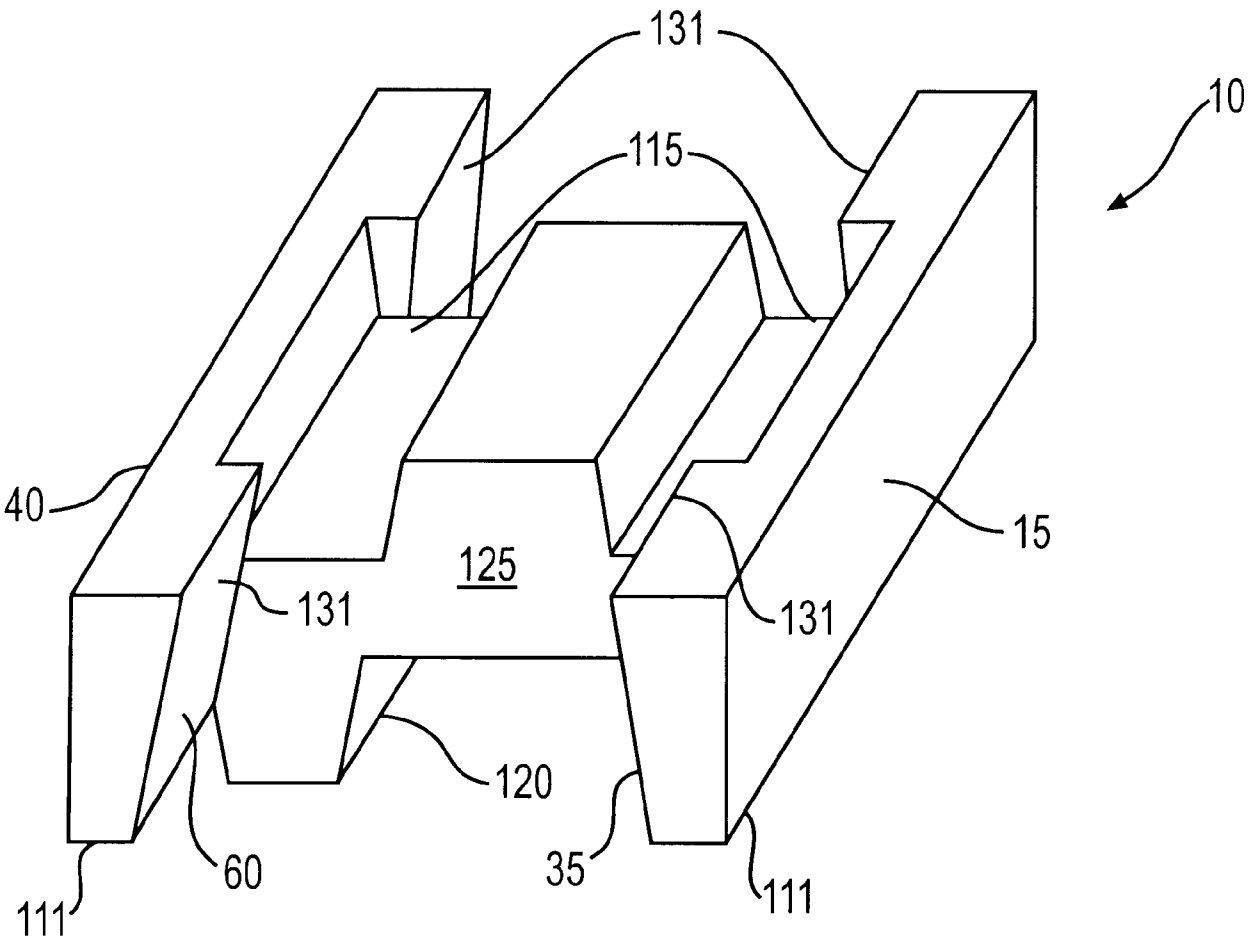
FIG. 6 is a bottom perspective view of the interlocking block of FIG. 1.

Located between sidewalls 15 and 40 respectively, and evenly spaced between medial and distal end-walls 65 and 80 respectively, are a plurality of spacers 120. Spacers 120 include a front sidewall 125, a back sidewall 130 (FIG. 2) and are shaped identically to medial and distal end-walls 65 and 80 respectively including possessing U-shaped cavities 95. See also FIG. 6, illustrating a bottom view of a straight interlocking block 10 showing spacers 120 and notches 115, wherein the view begins from sectional line 6—6 in FIG. 1.

As illustrated by FIG. 2, a plurality of cavities 135 are formed between spacers 120 and are bounded by inner surfaces 35 and 60 of first and second sidewalls 15 and 40 respectively, front sidewalls 125 of spacers 120 and back sidewalls 130 of an opposing spacer 120. An identically shaped cavity 135 is formed at medial ends 20 and 45 of first and second sidewalls 15 and 40 respectively and is bounded by inner surfaces 35 and 60 of first and second sidewalls 15 and 40, inner surface 66 of medial end-wall 65 and a front sidewall 125 of a spacer 120. Similarly, a cavity 135 is also formed at distal ends 25 and 50 of first and second sidewalls 15 and 40 respectively and is bounded by inner surfaces 35 and 60 of first and second sidewalls 15 and 40, inner surface 81 of distal end-wall 80 and a back sidewall 130 of a spacer 120.

In the preferred embodiment, first and second sidewall 15 and 40 respectively, medial and distal end-walls 65 and 80 respectively and spacers 120 may be integrally formed from a concrete mixture incorporating polystyrene beads, or steel, glass or plastic fibers and has a density of between 600 and 1400 $Kg/m^3$. The ratio between the gross concrete mix and the polystyrene beads is preferably between 53% to 70% of the polystyrene beads, by volume.

As illustrated in FIGS. 1 and 2, first and second sidewall 15 and 40 respectively may be of any desired length and any number of spacers may be incorporated. Preferably, first and second sidewalls 15 and 40 respectively are 125 centimeters in length, 2.5 to 3.5 centimeters in width and 20 centimeters in height. In the final assembly, straight interlocking block 10 may be from 15 to 30 cm. in width. Projecting portions 110 extend above upper surface 111 for about 3 centimeters. It should be appreciated that these dimensions have been selected for the operability provided to straight interlocking block 10 by these dimensions. Spacers 120 are preferably 6 centimeters in width and are spaced 25 centimeters apart and medial end-wall 65 and distal end-wall 80 are one-half the thickness of spacers 120. Projecting portions 110 and notches 115 may have any desired profile including rectangular shapes or modifications thereof although, it has been determined that the illustrated tapered shape provides greater structural integrity.

Additionally, inner surfaces 35 and 60 of first sidewall 15 and second sidewall 40 respectively may slope generally upwardly and outwardly at an angle of between 3° and 10° degrees. In such a configuration, a bottom of each first sidewall 15 and second sidewall 40 would therefore be wider than a top of each first sidewall 15 and second sidewall 40. Consequently, inner surfaces 35 and 60 of each first sidewall 15 and second sidewall 40 respectively would necessarily include indentations (see FIG. 3) positioned to accommodate each notch 115. These indentations thereby define locking portions 131 along the bottom inner edges of the first sidewall 15 and the second sidewall 40 (See also FIG. 6).

Figure 3:
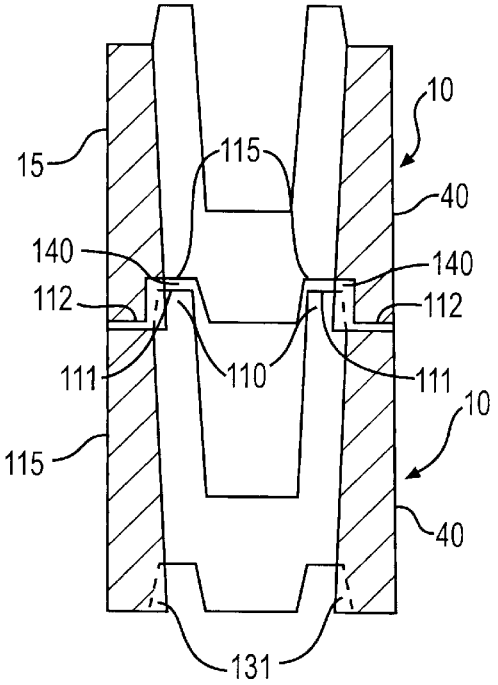
FIG. 3 is a cross-sectional view of two interconnecting blocks of FIG. 1 placed one on top of the other and constructed in accordance with a preferred embodiment of the invention.
Figure 4:
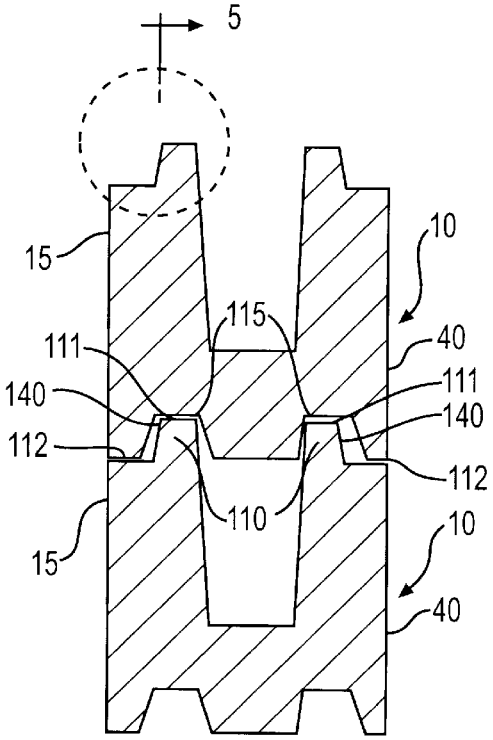
FIG. 4 is a cross-sectional view of two interlocking blocks placed one on top of the other and assembled in accordance with a preferred embodiment of the invention.

In a preferred application illustrated in FIGS. 3 and 4, any number of straight interlocking blocks 10 may be assembled into a self-locking, self-supporting wall. With reference to FIG. 4, a self locking wall may be assembled by placing a lower surface 112 of an upper straight interlocking block 10 on top of an upper surface 111 of a lower straight interlocking block 10. When properly assembled, projecting portion 110 of the lower straight interlocking block 10 fits into a matching notch 115 in the adjacent upper straight interlocking block 10, leaving a small interstitial cavity 140 between projecting portion 110 and notches 115. Preferably, cavity 140 is smaller than 6 millimeters. Notch 115 and projecting portion 110 cooperate to securely align and hold each straight interlocking block 10 in place wherein the locking portions 131 of the first sidewall 15 and the second sidewall 40 are positioned between adjacent projecting portions 10. This in turn secures the blocks 10 together both laterally and transversely. As a result, no mortar is required between joints securing each pair of straight interlocking blocks 10.

As is evident from FIG. 1, cavities 135 are open at their respective top and bottom ends and communicate with adjacent cavities 135 through each U-shaped cavity 95. When straight interlocking blocks 10 are assembled one on top of another, each cavity 135 of a lower straight interlocking block 10 communicates with each cavity 135 of an upper straight interlocking block 10. In this manner, vertical columns of cavities 135 are formed throughout the self-locking, self-supporting wall and horizontal shafts are formed throughout the self-locking, self-supporting wall.

Figure 5:
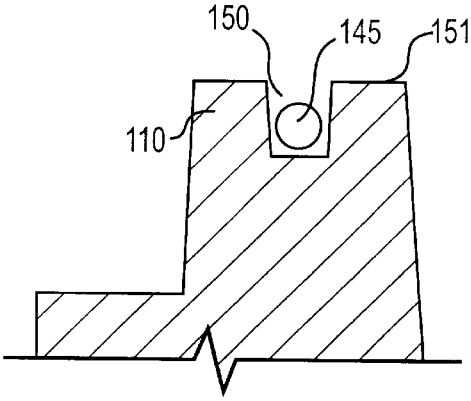
FIG. 5 is an expanded view of FIG. 4 illustrating placement of horizontal reinforcing components inside an interlocking block in accordance with a preferred embodiment of the invention.

In order to create a stronger wall, straight interlocking blocks 10 may also function as form-work. With reference to FIG. 5, reinforcing rods 145 may be disposed horizontally through inwardly tapered grooves 150 located on an upper surface 151 of each projecting portion 110. Additionally, with reference to FIGS. 11 and 12, reinforcing rods 145 may be disposed vertically through each vertical column of cavities 135.

Following installation of the reinforcing rods 145, a supporting material (not shown) may be injected or poured into a cavity 135. Because each cavity 135 communicates with horizontally and vertically adjacent cavities 135, supporting material (not shown) may flow through, and completely fill, all cavities 135 throughout the self-locking, self-supporting wall. Supporting material (not shown), reinforcing rods 145 and straight interlocking blocks 10 then form a solid, integrally formed load bearing wall.

In this configuration, medial end-walls 65 and distal end-walls 80 of straight interlocking blocks 10 incorporated into terminal ends of an assembled wall may also be constructed without a U-shaped cavity 95 in order to prevent supporting material (not shown) from flowing out of U-shaped cavities 95 and exiting the assembled wall.

Additionally, the vertical columns and horizontal shafts within the self-locking, self-supporting wall may be filled with insulating material, sound absorbing material or function as conduits for pipes or electrical wires.

FIGS. 15 through 17 illustrate an application of straight interlocking blocks 10 functioning as a lintel, i.e., a support member over a door or window. As evident in FIG. 17, bottom portions of cavities 135 positioned directly over a doorway or window are sealed to define the doorway's and window's boundary and to prevent supporting material (not shown) from flowing out of each cavity 135. Each U-shaped cavity 95 is left open allowing supporting material (not shown) to flow through the lintel.

Figure 20:
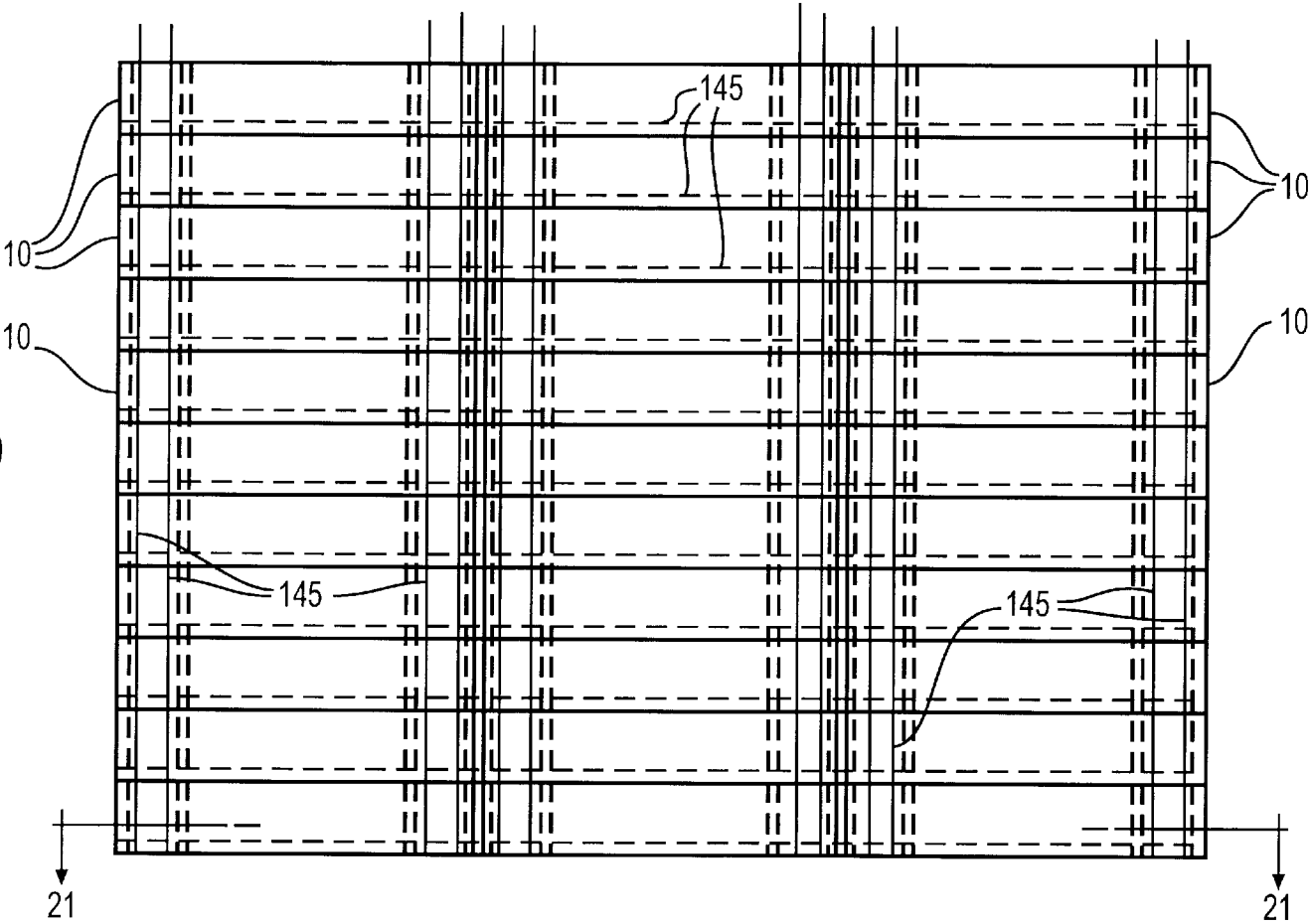
FIG. 20 is a side view of a pre-formed wall constructed in accordance with preferred embodiment of the invention.
Figure 21:
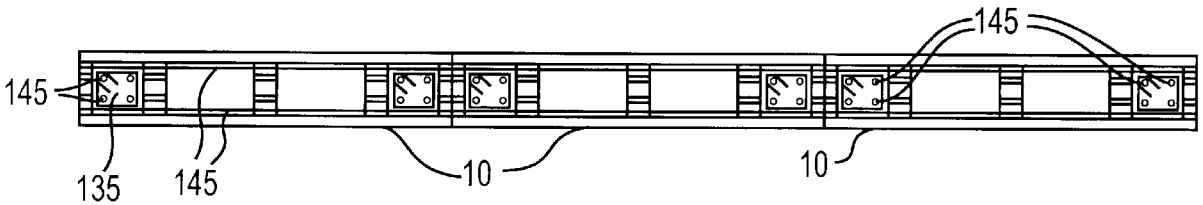
FIG. 21 is a top view of a pre-formed wall constructed in accordance with preferred embodiment of the invention.

FIGS. 20 and 21 illustrate yet another application of straight interlocking blocks 10. As evident from FIG. 20, any number of interlocking blocks 10, including reinforcing rods 145 and supporting material (not shown), may be pre-assembled into a wall of predetermined dimensions. These wall segments may be manufactured prior to construction of the intended structure. In this manner, pre-formed wall segments may be delivered to a construction site and lifted into place in an orderly and timely fashion, thereby decreasing on-site construction time and increasing the overall efficiency of the construction operation.

Straight interlocking blocks 10 forming edges of pre-formed wall segments are illustrated in FIGS. 18 and 19. With reference to FIG. 19, U-shaped cavities 95 in each spacer 120 located adjacent medial and distal end-walls 65 and 80 respectively are enclosed. As a result, columns of cavities 135 communicating in a vertical direction but not a horizontal direction are formed. Reinforcing material (not shown) such as steel may be secured within these columns laid through every course and anchored in the columns carry the weight of the wall during lifting. During lifting, reinforcing material (not shown) and supporting material (not shown) may then be disposed within the columns. This reinforced pre-formed wall then may be lifted into a desired location. See FIGS. 20 and 21. It should be appreciated that the pre-formed wall may be positioned and then reinforced or supported on site.

An additional embodiment of straight interlocking blocks 10 is shown in FIGS. 22 through 25. For clarity, like elements have been provided with like reference numerals having an added prime (') notation. The discussion below will focus on differences between the preferred embodiment discussed above and the additional embodiment illustrated in FIGS. 22 through 25. Other elements and features of the additional embodiment which are not specifically addressed or illustrated are understood to be similar to those discussed above.

Figure 22:
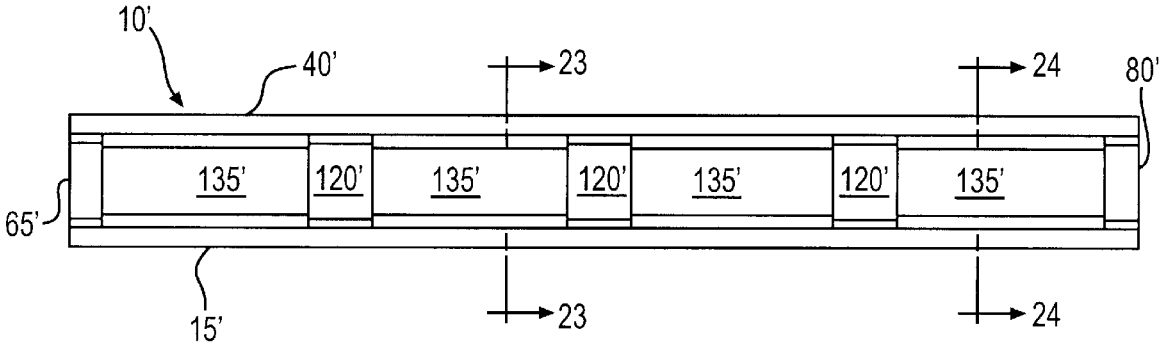
FIG. 22 is a top view of an alternative embodiment of an interlocking block constructed in accordance with an alternate embodiment of the invention.

With reference to FIG. 22, an elongated straight interlocking block 10' includes a first sidewall 15' and a second sidewall 40'. First sidewall 15' and second sidewall 40' are held in parallel opposition by a plurality of evenly placed spacers 120' and a medial end-wall 65' and a distal end-wall 80' located at opposing ends of first sidewall 15' and second sidewall 40'. Spacers 120', medial end-wall 65' and distal end-wall 80' are generally rectangular in shape and include an inwardly tapered projecting portion 110' extending for a short distance above each upper surfaces 111' of first sidewall 15' and second sidewall 40'. See also FIGS. 23 and 24.

Figure 23:
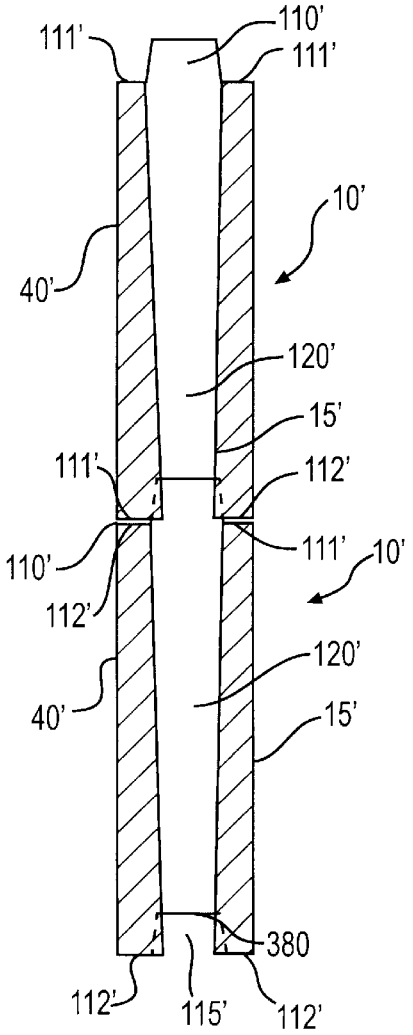
FIG. 23 is a cross sectional view of the interlocking blocks of FIG. 22 which are taken along lines 23–23' and stacked one on top of the other.
Figure 24:
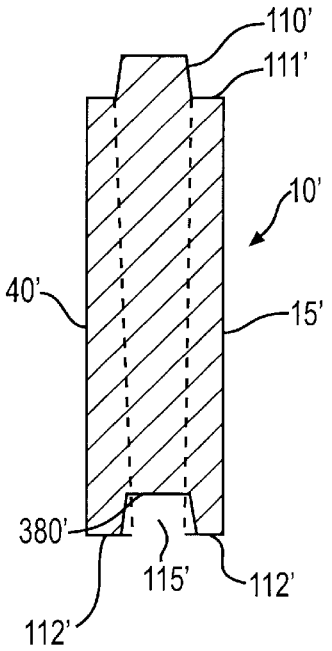
FIG. 24 is a cross sectional view of the block of FIG. 22 taken along lines 24–24'.
Figure 25:
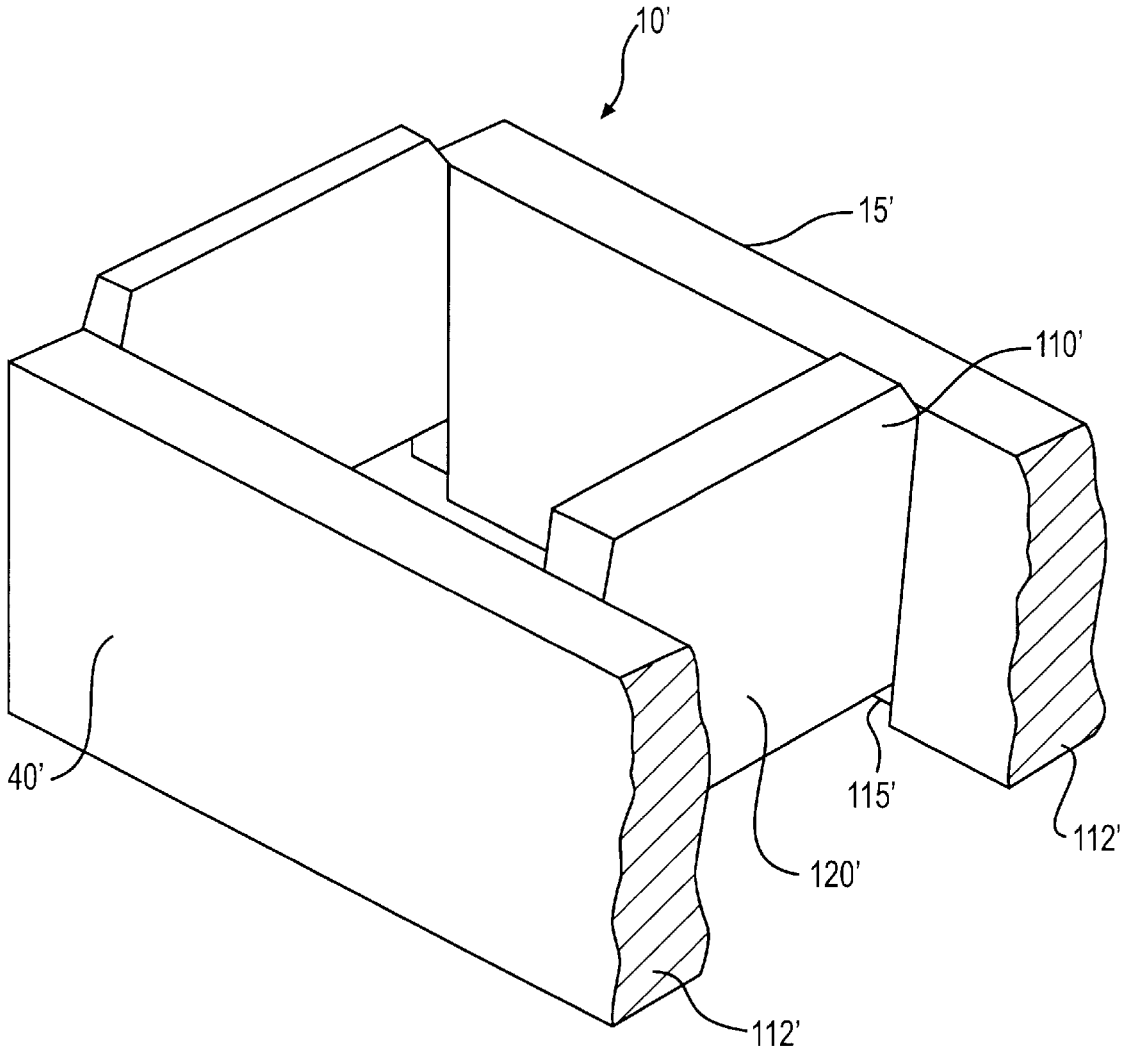
FIG. 25 is a perspective view of the interlocking block illustrated in FIG. 22.
Figure 26:
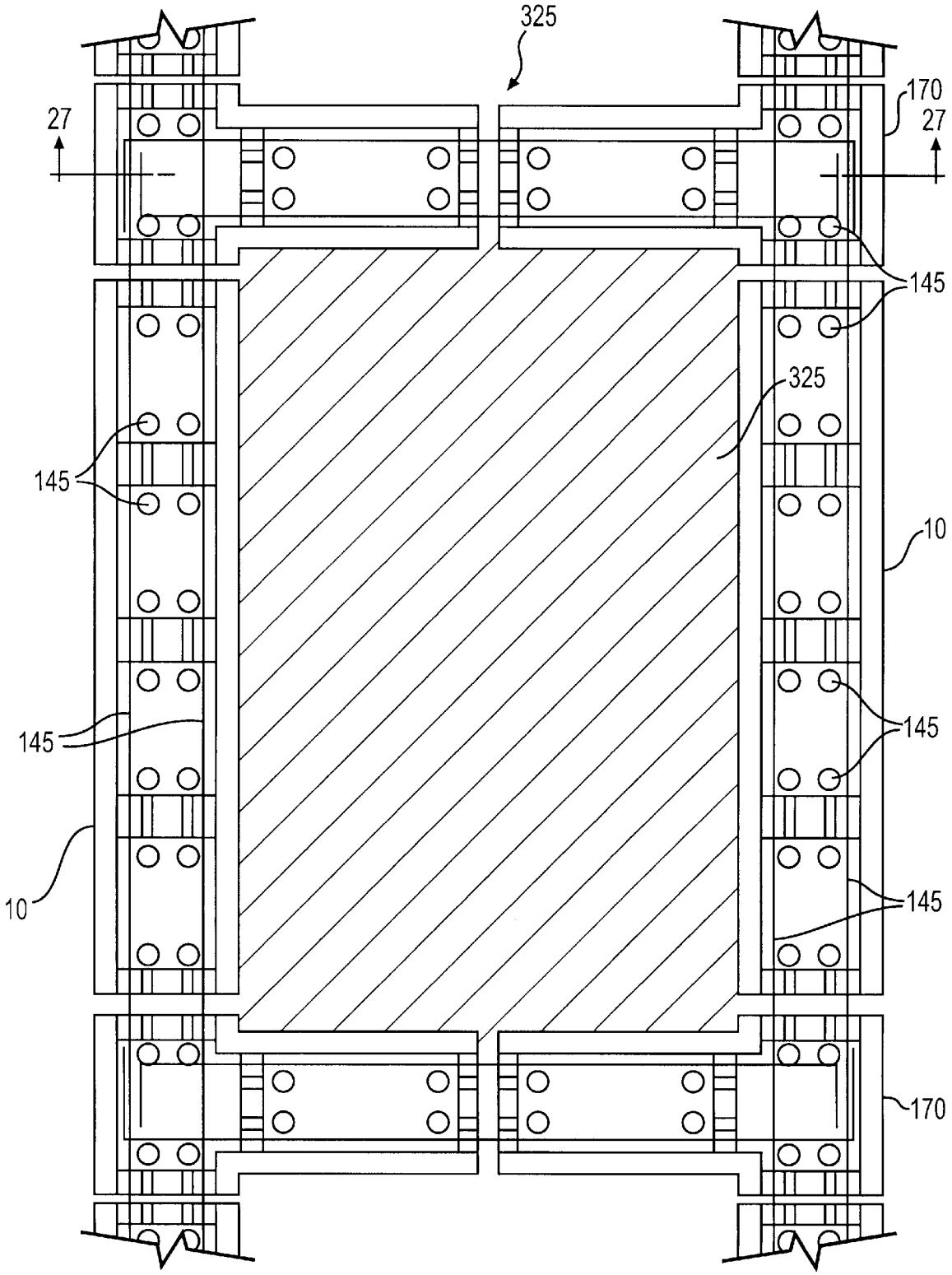
FIG. 26 is a top view of a box-type retaining wall constructed in accordance with a preferred embodiment of the invention.
Figure 27:
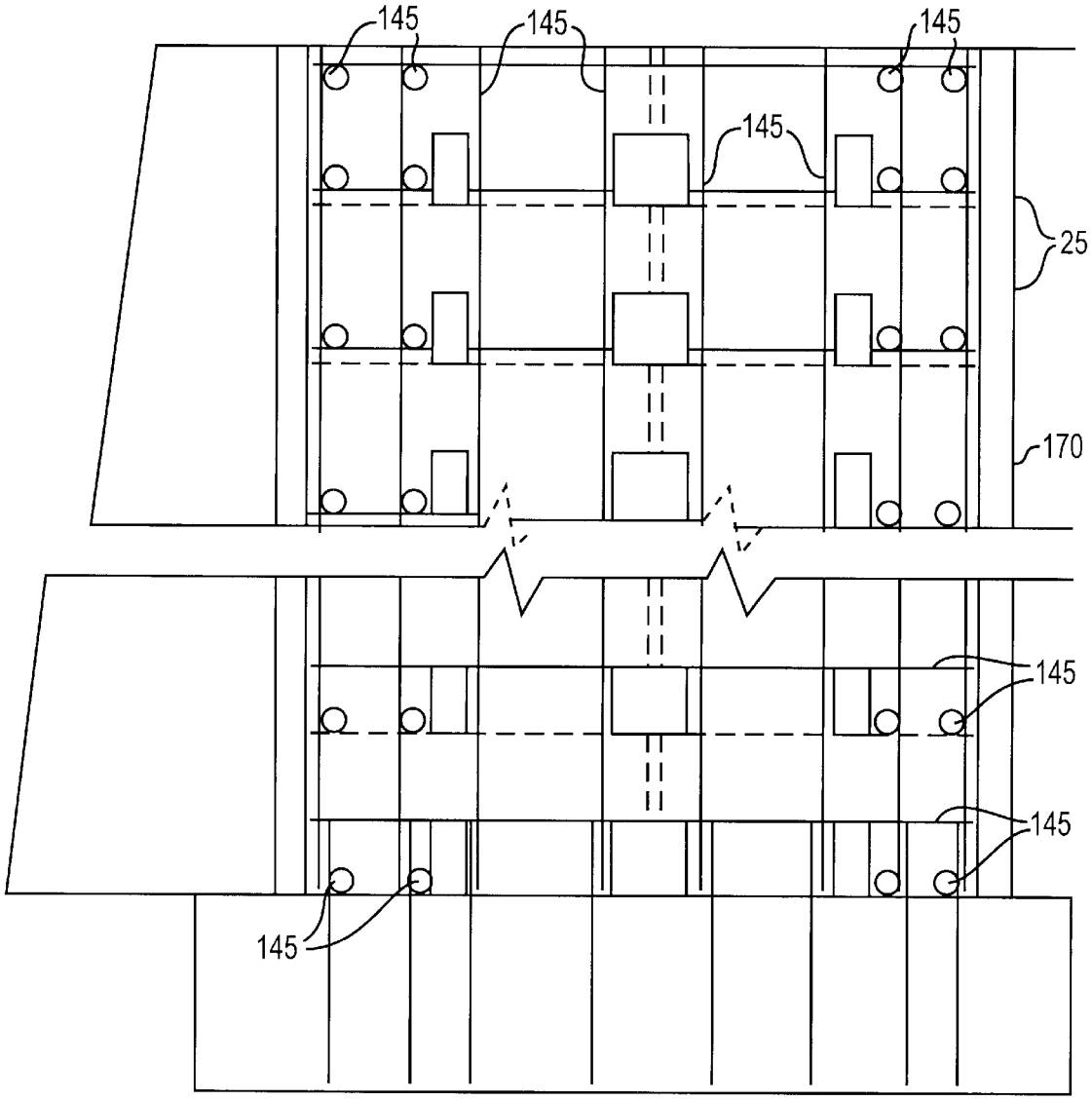
FIG. 27 is a cross sectional view of a retaining wall constructed in accordance with a preferred embodiment of the invention.

With reference to FIGS. 23 and 24, a bottom 380 of spacers 120', medial end-wall 65' and distal end-wall 80' is located a short distance above a lower surface 112' of first sidewall 15' and second sidewall 40'. As a result, a notch 115' is formed. Notch 115' is bounded by lower ends of opposing inner faces (not shown) of first sidewall 15' and second sidewall 40', and lower surfaces (not shown) of spacers 120', medial end-wall 65' and distal end-wall 80'.

Notch 115' is positioned, and is of sufficient size and dimensions, to receive and secure each projecting portion 110' of an adjacent straight interlocking block 10'. Constructed in this configuration, any number of straight interlocking blocks 10' may be securely stacked on top of one another as previously described.

Preferably, elongated straight interlocking block 10' is integrally formed from a concrete mixture incorporating polystyrene beads, or steel, glass or plastic fibers and has a density of between 600 and 1400 $Kg/m^3$. By way of illustration but not limitation, first sidewall 15' and second sidewall 40' may be 20 centimeters in height, 120 centimeters in length, and 8 to 12 centimeters in width. Notch 115' may extend 3 centimeters above lower surfaces 112' of first sidewall 15' and second sidewall 40'. It should be appreciated that these dimensions have been selected for the operability provided to block 10' by these dimensions. Additionally, notch 115' may have any desired profile including rectangular shapes or modifications thereof.

In a preferred embodiment, spacers 120', medial end-wall 65' and distal end-wall 80' are of generally identical shapes and sizes. It is understood, however, that medial end-wall 65' and distal end-wall 80' are one-half the thickness of spacers 120'.

Additionally, inner surfaces of first sidewall 15' and second sidewall 40' may slope generally outwardly. In such a configuration, a bottom of each first sidewall 15' and second sidewall 40' would therefore be wider than a top of each first sidewall 15' and second sidewall 40'. Consequently, inner surfaces of each first sidewall 15' and second sidewall 40' would necessarily include indentations positioned and configured to accommodate each notch 115'.

T-shaped Block

As illustrated in FIGS. 7, 9, 11 and 13, an interlocking T-shaped block 170 may also be constructed and incorporated into structures employing straight interlocking blocks 10. See FIG. 9. More specifically and with reference to FIGS. 9 and 11, T-shaped block 170 may be employed at a junction of two perpendicular walls constructed of straight interlocking blocks 10. With respect to FIG. 7, T-shaped block 170 includes a sidewall 175 having a medial end 180, a distal end 185, and an inner surface 190. T-shaped block 170 also includes a first L-shaped sidewall 195 having a first end 200, a second end 205 and an inner surface 210; and a second L-shaped sidewall 215 having a first end 220, a second end 225 and an inner surface 230.

Sidewall 175, first ends 200 and 220 of first and second L-shaped sidewalls 195 and 215 respectively are integrally formed with, and rigidly held in opposition by, medial end-wall 65 and distal end-wall 80 as described above. Each medial end-wall 65 and distal end-wall 80 includes a generally U-shaped cavity 95, projecting portion 110 and notch 115 and defining a cavity 135 as described above. It should be appreciated that the embodiment illustrated in FIG. 22 will not have this U-shaped cavity 95.

Additionally, inner surfaces 210 and 230 adjacent second ends 205 and 225 of first and second L-shaped sidewalls 195 and 215 respectively are integrally formed with, and rigidly held in opposition by, second end-wall 235. Second end-wall 235 is shaped identically to medial and distal end-walls 65 and 80 respectively as described above, including a number of previously described projecting portions 110.

Third end-wall 240, is located adjacent and is shaped identically to, second end-wall 235 and includes an outer surface 245 and an inner surface 250. Outer surface 245 of third end-wall 240 is opposite face 245 is not flush with 220. There is an offset equal to the thickness of the wall. In this configuration, inner surface 250 of third end-wall 240 opposes an inner face of second end-wall 235.

In the embodiment described above, a cavity 135 is bounded by inner surface 190 of sidewall 175, inner surface 210 of first L-shaped sidewall 195, inner surface 230 of second L-shaped sidewall 215, outer surface 245 of third end-wall 240, an inner surface 66 of medial end-wall 65 and inner surface (not shown) of distal end-wall 80. Additionally, a cavity 135 is also bounded by inner surface 210 of first L-shaped sidewall 195, inner surface 230 of second L-shaped sidewall 215, inner surface 250 of third end-wall 240 and inner surface of second end-wall 235.

Sidewall 175 of T-shaped block 170 may be 25 centimeters in length, and of equal width and height as straight interlocking block 10. Sidewall 175, first L-shaped sidewall 195, second L-shaped sidewall 215, second end-wall 235, and third end-wall 240 may be integrally formed from a concrete mixture incorporating polystyrene beads, or steel, glass or plastic fibers. Medial end-wall 65, distal end-wall 80 and second end-wall 235 are one-half as thick as third end-wall 240. Additionally, in the preferred embodiment, third end-wall 240 has the same dimensions as a spacer 120 utilized in straight interlocking block 10. See FIG. 1.

Figure 9:
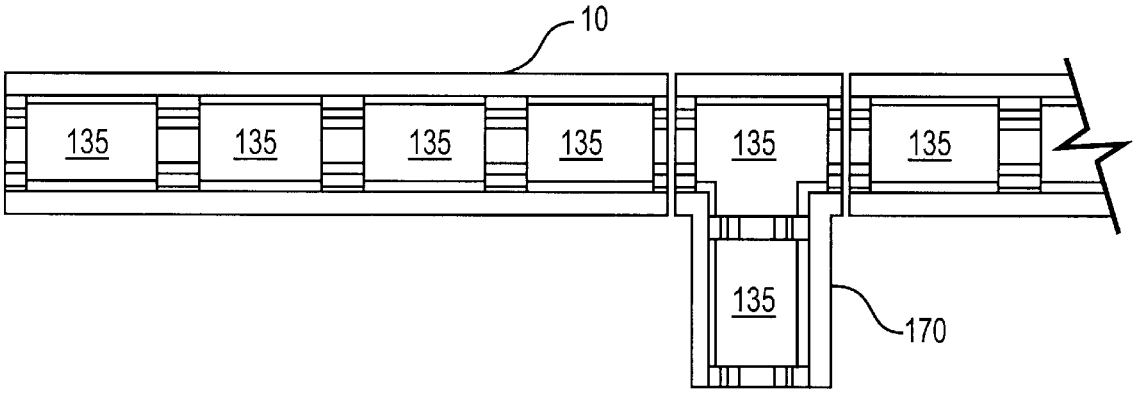
FIG. 9 is a top view of two intersecting walls incorporating the T-shaped block of FIG. 7.
Figure 10:
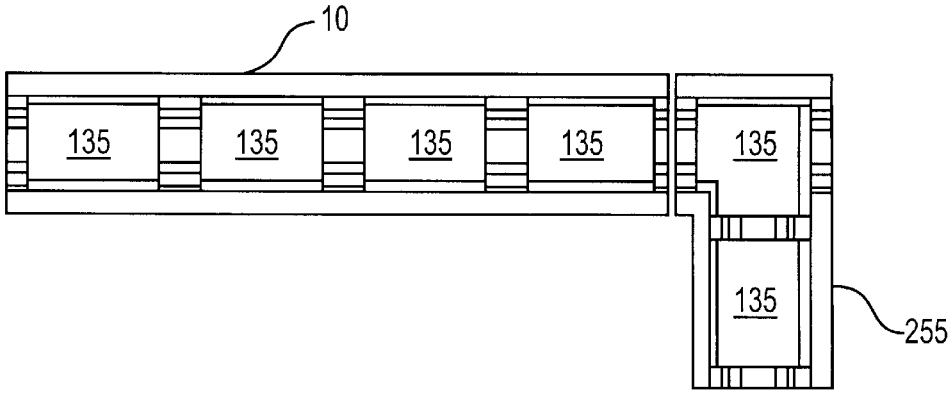
FIG. 10 is a top view of two intersecting walls incorporating the L-shaped block of FIG. 8.
Figure 11:
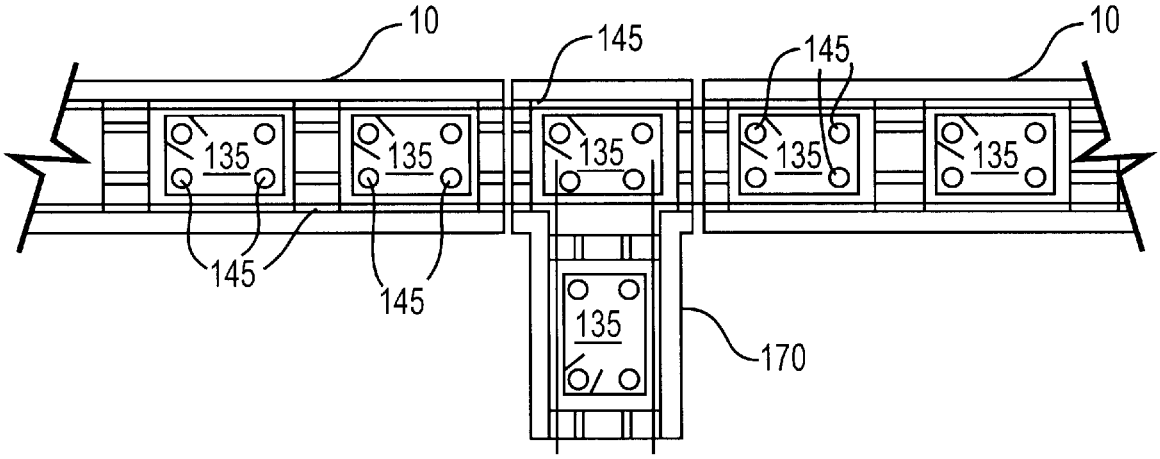
FIG. 11 is a top view of two intersecting walls incorporating the T-shaped block and structural reinforcement of FIG. 7.
Figure 12:
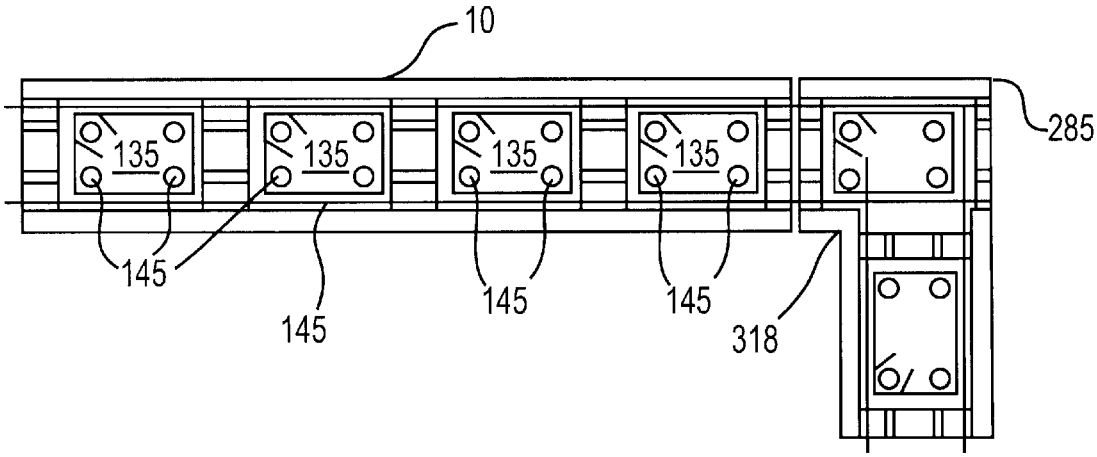
FIG. 12 is a top view of two intersecting walls incorporating the L-shaped block and structural reinforcement of FIG. 8.
Figure 13:
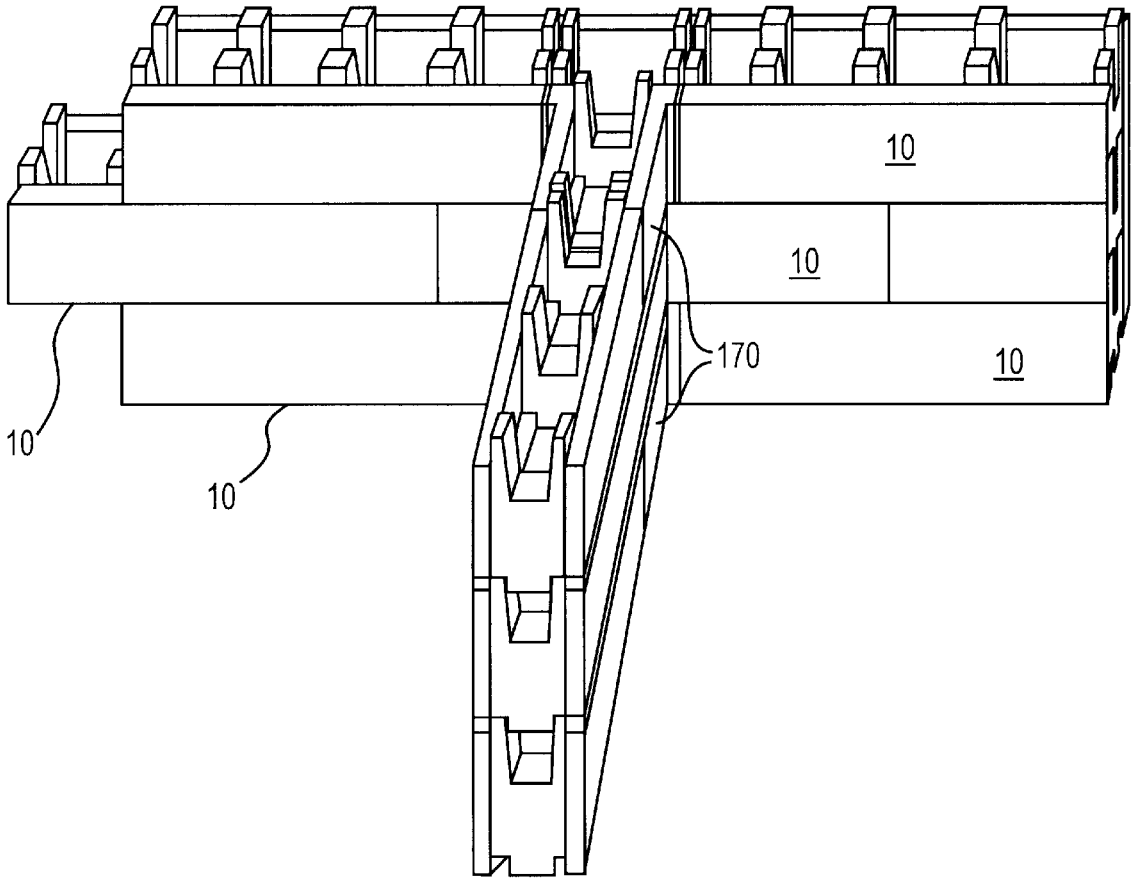
FIG. 13 is an elevational view of two intersecting walls incorporating the T-shaped blocks of FIG. 7.
Figure 14:
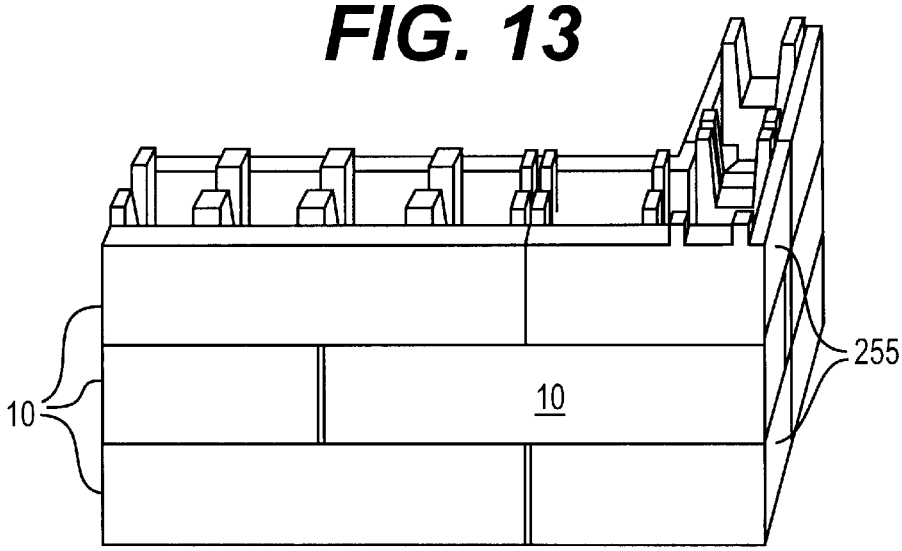
FIG. 14 is an elevational view of two intersecting walls incorporating L-shaped blocks of FIG. 8.

Any number of T-shaped blocks 170 may be stacked one on top of another as described above and may alternate with straight interlocking blocks 10. With reference to FIGS. 9 and 11, T-shaped block 170 may be incorporated into perpendicularly intersecting walls constructed of straight interlocking blocks 10. Additionally and with reference to FIG. 11, cavities 135 in T-shaped block 170 and cavities 135 in straight interlocking block 10 align to allow reinforcing rods 145, supporting material, insulation, pipes or conduits to be utilized as mentioned above. In this manner, uniform and integrally formed perpendicular walls may be constructed.

As explained in more detail above, inner surface 190, inner surface 210 and inner surface 230 may slope generally outwardly. Also, as explained above, inner surface 190, inner surface 210 and inner surface 230 may include indentations (not shown) positioned and configured to accommodate each projecting portion 110.

L-shaped Block

Figure 8:
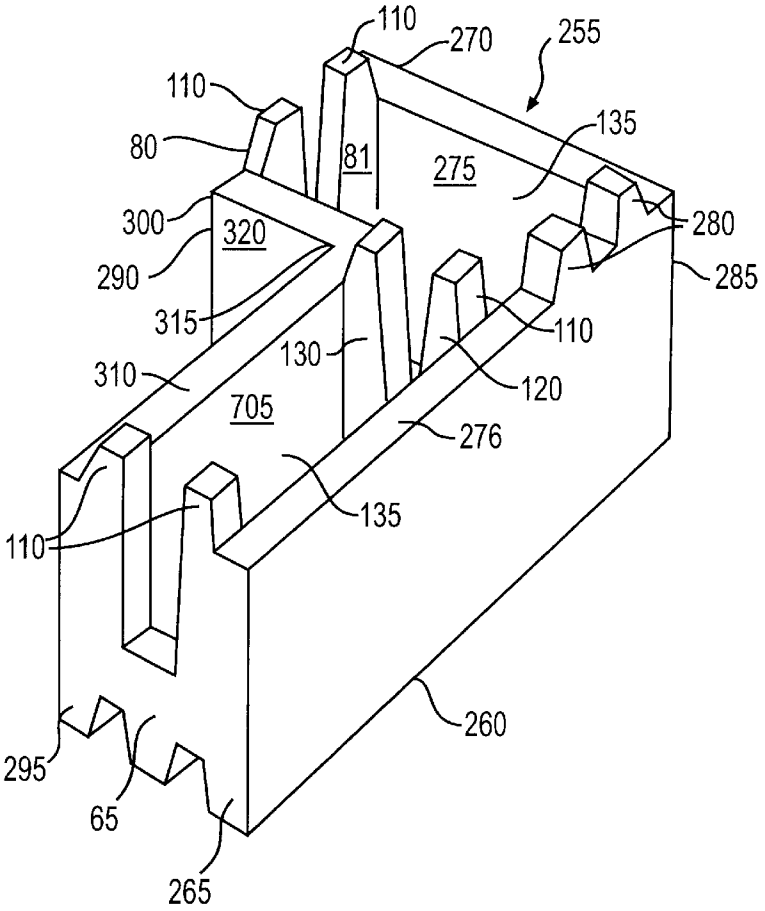
FIG. 8 is a perspective view of an L-shaped block constructed in accordance with a preferred embodiment of the invention.
Figure 7:
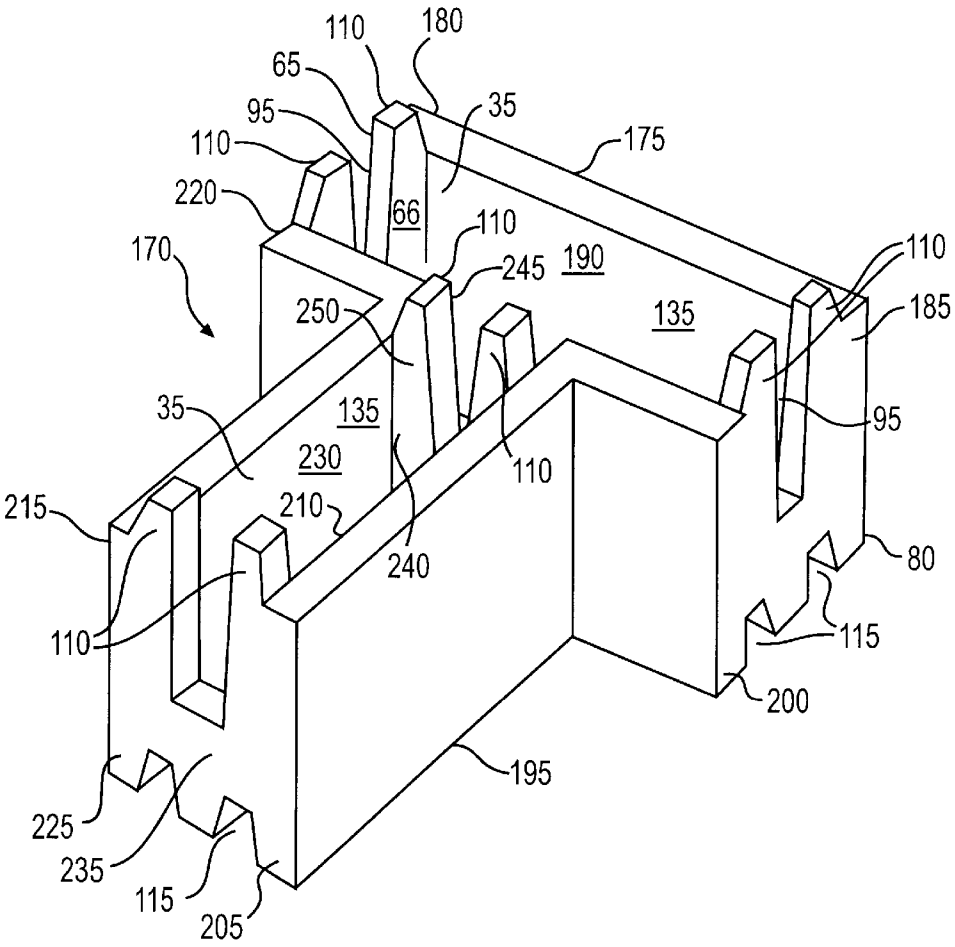
FIG. 7 is a perspective view of a T-shaped block constructed in accordance with a preferred embodiment of the invention.

An additional embodiment is illustrated in FIGS. 8, 10, 12 and 14. As evident from FIGS. 10 and 14, an L-shaped block 255 may be used to insert a 90 degree turn into an otherwise straight wall constructed of straight interlocking blocks 10. Referring to FIG. 8, L-shaped block 255 includes an outer L-shaped wall 260 having a first end 265, a second end 270, an inner surface 275, an upper surface 276 and two projections 280 located on upper surface 276 adjacent an elbow 285.

L-shaped block 255 also includes an inner L-shaped wall 290 having first end 295, and second end 300, an inner surface 305, an upper surface 310 and an elbow 315. Inner L-shaped wall 290 and outer L-shaped wall 295 are rigidly held in opposition by medial end-wall 65 located at first ends 265 and 295 of outer L-shaped wall 260 and inner L-shaped wall 290 respectively, and distal end-wall 80 located at second ends 270 and 300 of outer L-shaped wall 260 and inner L-shaped wall 290 respectively. Medial end-wall 65 and distal end-wall 80 have the configuration, construction and dimensions as described above including but not limited to projecting portions 110.

Additionally, a spacer 120 as described above is integrally formed with inner surfaces 275 and 305 of outer L-shaped wall 260 and inner L-shaped wall 290 respectively, and is positioned adjacent elbow 315 of inner L-shaped wall 290. A back sidewall of spacer 120 is flush with inner surface 305 of a perpendicular leg 320 of inner L-shaped wall 290. Projections 280 oppose and are of identical configuration, shape and dimensions as projecting portion 110 of distal end-wall 80.

In the embodiment described above, a cavity 135 is bounded by inner surface 275 of outer L-shaped sidewall 260, inner surface 305 of inner L-shaped sidewall 290, an inner surface of medial end-wall 65 and a back sidewall 130 of spacer 120. Additionally, a cavity 135 is also bounded by inner surface 275 of outer L-shaped sidewall 260, inner surface 305 of inner L-shaped sidewall 290, an inner surface 81 of distal end-wall 80 and a front sidewall of spacer 120.

In the preferred embodiment, L-shaped block 255 is equal in width and height to straight interlocking block 10. Additionally, outer L-shaped sidewall 260, inner L-shaped sidewall 290, spacer 120, medial end-wall 65 and distal end-wall 80 may be integrally formed from a concrete mixture incorporating polystyrene beads, or steel, glass or plastic fibers and has a density of between 600 and 1400 $Kg/m^3$. Medial end-wall 65 and distal end-wall 80 are understood to be one-half the thickness of spacer 120.

A number of L-shaped blocks 255 and interlocking blocks 10 may be stacked one upon another as described above. See FIG. 14. With respect to FIG. 12, L-shaped block 255 may be incorporated into a right-angled corner of a wall constructed from straight interlocking blocks 10. Assembled in such a fashion, cavities 135 in L-shaped block 255 and cavities 135 in straight interlocking block 10 align to allow reinforcing rods 145, supporting material, insulation, pipes or conduits to be utilized as mentioned above. In this manner, uniform and integrally constructed walls incorporate a 90 degree turn may be constructed. Although L-shaped block 255 has been described as facilitating a 90 degree turn, any other angle may be accomplished by altering the angles of elbows 315 and 285.

Pursuant to alternative embodiments, straight interlocking blocks 10, T-shaped blocks 170 and L-shaped blocks 255 may be collectively assembled into any desired configuration. More particularly, two configurations for retaining walls are discussed below.

As shown in FIG. 26 through 29, straight interlocking blocks 10, L-shaped blocks 255 and T-shaped blocks 170 may be assembled to form any number of gravity walls and other internal enclosures 325. The horizontal dimensions of each enclosure 325 may be controlled by increasing or decreasing the number of straight interlocking blocks 10, L-shaped blocks 255 and T-shaped blocks 170. Similarly, enclosure 325's vertical dimensions may be controlled by increasing or decreasing the number of straight interlocking blocks 10, L-shaped blocks 255 and T-shaped blocks 170. Gravel, fill dirt, grain or any other solid or liquid material to be contained may then be loaded into each enclosure 325. The number and configuration of each enclosure 325 may be tailored to the individual needs of a consumer.

Figure 28:
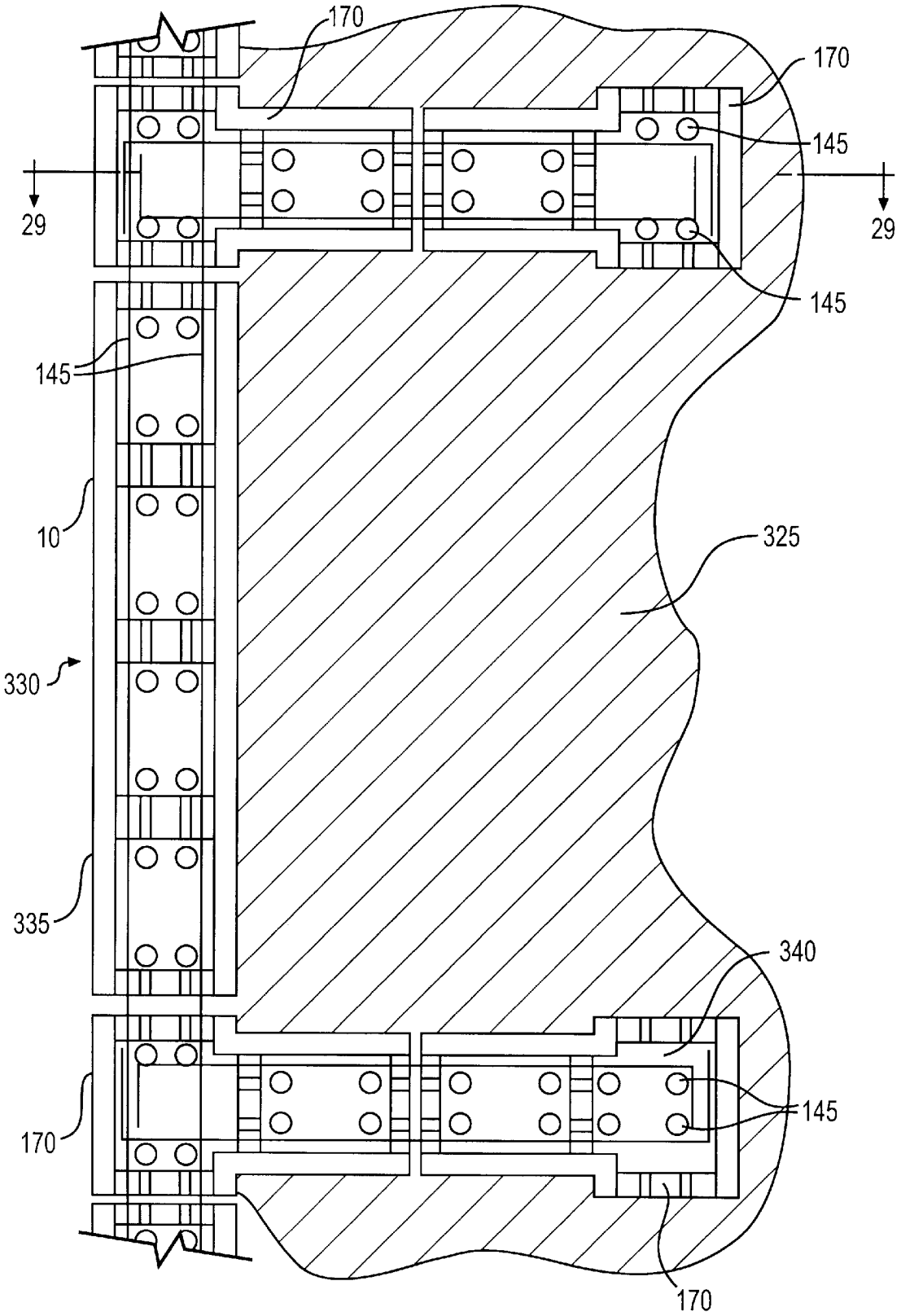
FIG. 28 is a top view of a buttressed type retaining wall constructed in accordance with a preferred embodiment of the invention.
Figure 29:
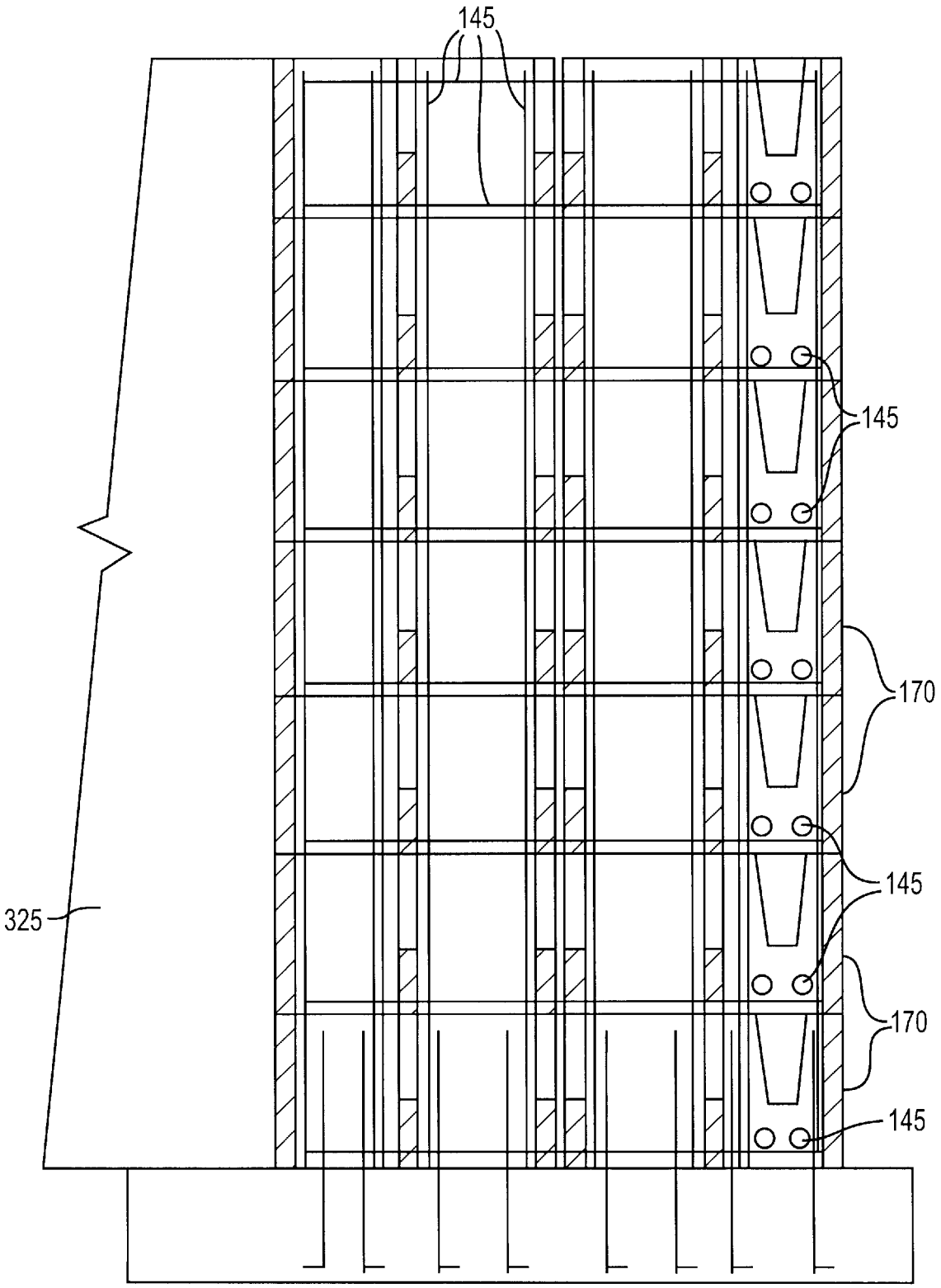
FIG. 29 across sectional view of a retaining wall constructed in accordance with a preferred embodiment of the invention.

As shown in FIG. 28, straight interlocking blocks 10 and T-shaped blocks 170 may also be assembled to form any number of buttressed retaining walls 330. Buttressed retaining walls 330 may be positioned to either enclose or restrain gravel, fill dirt, grain or any other solid or liquid material.

Horizontal dimensions of buttresses 340 and walls 335 may be controlled by increasing or decreasing the number of straight interlocking blocks 10 and T-shaped blocks 170. Similarly, the vertical dimensions of each buttressed retaining wall 330 may be controlled by increasing or decreasing the number of straight interlocking blocks 10, T-shaped blocks 170. Additionally, each buttressed retaining wall 330's precise location and configuration may be tailored to a consumer's individual needs.

Finally, in all of the illustrative embodiments discussed above, cavities 135 may be filled with reinforcing material, supporting material, duct-work, insulation, piping, electrical conduits or any other material. As noted earlier, the embodiments discussed above are representative and illustrative, but the present invention is not limited to solely to the discussed embodiments. Additionally, all features and aspects incorporated into one embodiment discussed above are understood to be incorporated into all other embodiments unless otherwise stated.

What is claimed:

1. A self-interlocking, self-aligning building block for building walls, comprising:

first and second sidewalls upstandingly positioned parallel to one another and extending along a horizontal length of said building block; and a first plurality of spacers transversely and fixedly positioned between said first and second sidewalls, said first plurality of spacers having at least two spacers one at each of a left end and a right end of said parallel first and second sidewalls, wherein said self-interlocking self-aligning building block is formed from concrete, each of said first plurality of spacers includes a spacer portion fixedly separating said first and second sidewalls, and at least first and second projecting portions formed vertically along inner side surfaces of said first and second sidewalls, respectively, and extending above upper surfaces of said first and second sidewalls, respectively, and each one of said first plurality of spacers includes a notch defined along a bottom portion of said one of said spacers and a corresponding one of said first or second sidewalls and formed such that a notch of a first building block is adapted to inter-engage with a corresponding projecting portion of a second building block positioned under said first building block, said notch of each of said plurality of spacers having means for positionally locking said first building block with second building block whereby lateral and transverse movement therebetween is prevented.

2. A self-interlocking, self-aligning building block according to claim 1, wherein locking means of said notch in each of said first plurality of spacers includes a locking portion defined along a bottom edge of a corresponding one of said first or second sidewalls, said locking portion being formed so as to abut against said corresponding projecting portion of said second building block to thereby prevent lateral movement between said first and second building blocks.

3. A self-locking, self-aligning building block according to claim 1, wherein a bottom opening is defined between said inner side surfaces of said first and second sidewalls and between each adjacent pair of said first plurality of spacers.

4. A self-locking, self-aligning building block according to claim 1, wherein each of said projecting portions of said first plurality of spacers includes a tapered groove defined along a top surface thereof and extending horizontally parallel to said first and second side walls, whereby reinforcing rods may be horizontally positioned through a building block along at least one of said first and second sidewalls via grooves on said projecting portions of a corresponding one of said first and second sidewalls.

5. A self-locking, self-aligning building block according to claim 1, wherein a bottom opening is defined between said inner side surfaces of said first and second sidewalls and between each adjacent pair of said first plurality of spacers to accommodate at least one reinforcing rod vertically positioned through a building block.

6. A self-locking, self-aligning building block according to claim 1, wherein said first and second projecting portions of each of said first plurality of spacers are further formed with said spacer portion as a single projecting portion vertically extending above said upper surfaces of said first and second sidewalls and transversely between said first and second sidewalls.

7. A self-locking, self-aligning building block according to claim 1, further comprising:

third and fourth sidewalls upstandingly positioned parallel to one another and extending perpendicular to said horizontal length of said building block, said third sidewall being integrally connected at a right end of said first and second sidewalls to form a T-shaped intersection therewith; and a second plurality of spacers transversely and fixedly positioned between said third and fourth sidewalls, said second plurality of spacers having at least two spacers one at each of a front end and a rear end of said parallel third and fourth sidewalls, wherein each of said second plurality of spacers includes a spacer portion fixedly separating said third and fourth sidewalls, and at least third and fourth projecting portions formed vertically along inner side surfaces of said third and fourth sidewalls, respectively, and extending above upper surfaces of said third and fourth sidewalls, respectively, and each one of said second plurality of spacers includes a notch defined along a bottom portion of said one of said spacers and a corresponding one of said third or fourth sidewalls.

8. A self-locking, self-aligning building block according to claim 1, further comprising:

third and fourth sidewalls upstandingly positioned parallel to one another and extending perpendicular to said horizontal length of said building block, said third sidewall being integrally connected at a right end of said first and second sidewalls to form an L-shaped intersection therewith; and a second plurality of spacers transversely and fixedly positioned between said third and fourth sidewalls, said second plurality of spacers having at least two spacers one at each of a front end and a rear end of said parallel third and fourth sidewalls, wherein each of said second plurality of spacers includes a spacer portion fixedly separating said third and fourth sidewalls, and at least third and fourth projecting portions formed vertically along inner side surfaces of said third and fourth sidewalls, respectively, and extending above upper surfaces of said third and fourth sidewalls, respectively, and each one of said second plurality of spacers includes a notch defined along a bottom portion of said one of said spacers and a corresponding one of said third or fourth sidewalls.

9. A self-locking, self-aligning building block according to claim 1, wherein said first and second sidewalls and said plurality of spacers are formed from a concrete mixture incorporating at least one material selected from polystyrene beads, steel, glass and plastic fibers.

10. A self-locking, self-aligning building block according to claim 9, wherein said first and second sidewalls and said plurality of spacers are further formed from a concrete mixture to have a density in the range of 600 to 1400 $Kg/m^3$.

11. A self-locking, self-aligning building block according to claim 1, wherein said inner side surfaces of said first and second sidewalls are inclined upwardly and outwardly at an angle of 3 to 10° from a vertical axis.

12. A self-locking, self-aligning building block according to claim 1, wherein said first and second sidewalls along with said at least two spacers of said plurality of spacers define a cavity therebetween in which additional building materials and components are introduced.

13. A self-locking, self-aligning building block according to claim 12, wherein said first and second protecting portions and said spacer portion of each of said plurality of spacers define an opening through which said additional building materials and components are introduced into a building block.

14. A system of self-locking, self-aligning blocks for building walls, comprising:

a plurality of building blocks formed from concrete, each having first and second sidewalls upstandingly positioned parallel to one another and extending along a horizontal length of said building block, and a first plurality of spacers transversely and fixedly positioned between said first and second sidewalls, said first plurality of spacers having at least two spacers one at each of a left end and a right end of said parallel first and second sidewalls, wherein each of said first plurality of spacers includes a spacer portion fixedly separating said first and second sidewalls, and at least first and second projecting portions formed vertically along inner side surfaces of said first and second sidewalls, respectively, and extending above upper surfaces of said first and second sidewalls, respectively, each one of said first plurality of spacers includes a notch defined along a bottom portion of said one of said spacers and a corresponding one of said first or second sidewalls and formed such that a notch of a first building block interengages with a corresponding projecting portion of a second building block positioned under said first building block, said notch of each of said plurality of spacers having means for positionally locking said first building block with second building block so as to prevent lateral and transverse movement therebetween, and said first and second sidewalls along with said at least two spacers of said plurality of spacers define a cavity therebetween; and support material for occupying said cavity in each of said plurality of concrete building blocks, said support material being formed into said cavity to at least one of provide reinforcement for said plurality of building blocks, introduce additional building material into each of said building blocks and feed building components through said building blocks.

15. A system according to claim 14, further comprising:

a plurality of concrete T-intersection blocks for forming T-intersection walls with said plurality of concrete building blocks, each of said T-intersection block including first and second sidewalls upstandingly positioned parallel to one another and extending along a horizontal length of said T-intersection block, and a first plurality of spacers transversely and fixedly positioned between said first and second sidewalls, said first plurality of spacers having at least two spacers one at each of a left end and a right end of said parallel first and second sidewalls, third and fourth sidewalls upstandingly positioned parallel to one another and extending perpendicular to said horizontal length of said building block, said third sidewall being integrally connected at a right end of said first and second sidewalls to form a T-shaped intersection therewith, and a second plurality of spacers transversely and fixedly positioned between said third and fourth sidewalls, said second plurality of spacers having at least two spacers one at each of a front end and a rear end of said parallel third and fourth sidewalls, wherein each of said first plurality of spacers includes a spacer portion fixedly separating said first and second sidewalls, and at least first and second projecting portions formed vertically along inner side surfaces of said first and second sidewalls, respectively, and extending above upper surfaces of said first and second sidewalls, respectively, each one of said first plurality of spacers includes a notch defined along a bottom portion of said one of said spacers and a corresponding one of said first or second sidewalls each of said second plurality of spacers includes a spacer portion fixedly separating said third and fourth sidewalls, and at least third and fourth projecting portions formed vertically along inner side surfaces of said third and fourth sidewalls, respectively, and extending above upper surfaces of said third and fourth sidewalls, respectively, and each one of said second plurality of spacers includes a notch defined along a bottom portion of said one of said spacers and a corresponding one of said third or fourth sidewalls.

16. A system according to claim 14, further comprising:

a plurality of concrete L-intersection blocks for forming L-intersection walls with said plurality of concrete building blocks, each of said L-intersection blocks including first and second sidewalls upstandingly positioned parallel to one another and extending along a horizontal length of said L-intersection block, and a first plurality of spacers transversely and fixedly positioned between said first and second sidewalls, said first plurality of spacers having at least two spacers one at each of a left end and a right end of said parallel first and second sidewalls, third and fourth sidewalls upstandingly positioned parallel to one another and extending perpendicular to said horizontal length of said building block, said third sidewall being integrally connected at a right end of said first and second sidewalls to form a L-shaped intersection therewith, and a second plurality of spacers transversely and fixedly positioned between said third and fourth sidewalls, said second plurality of spacers having at least two spacers one at each of a front end and a rear end of said parallel third and fourth sidewalls, wherein each of said first plurality of spacers includes a spacer portion fixedly separating said first and second sidewalls, and at least first and second projecting portions formed vertically along inner side surfaces of said first and second sidewalls, respectively, and extending above upper surfaces of said first and second sidewalls, respectively, each one of said first plurality of spacers includes a notch defined along a bottom portion of said one of said spacers and a corresponding one of said first or second sidewalls each of said second plurality of spacers includes a spacer portion fixedly separating said third and fourth sidewalls, and at least third and fourth projecting portions formed vertically along inner side surfaces of said third and fourth sidewalls, respectively, and extending above upper surfaces of said third and fourth sidewalls, respectively, and each one of said second plurality of spacers includes a notch defined along a bottom portion of said one of said spacers and a corresponding one of said third or fourth sidewalls.

17. A system according to claim 14, wherein said locking means in said notch in each of said first plurality of spacers includes a locking portion defined along a bottom edge of a corresponding one of said first or second sidewalls, said locking portion being formed so as to abut against said corresponding projecting portion of said second building block to thereby prevent lateral movement between said first and second building blocks.

18. A system according to claim 14, wherein each of said projecting portions of said first plurality of spacers includes a tapered groove defined along a top surface thereof and extending horizontally parallel to said first and second side walls, whereby reinforcing rods may be horizontally positioned through a building block along at least one of said first and second sidewalls via grooves on said projecting portions of a corresponding one of said first and second sidewalls.

19. A system according to claim 14, wherein said first and second sidewalls and said plurality of spacers of said plurality of building blocks are formed from a concrete mixture incorporating at least one material selected from polystyrene beads, steel, glass and plastic fibers.

20. A system according to claim 19, wherein said first and second sidewalls and said plurality of spacers are further formed from a concrete mixture to have a density in the range of 600 to 1400 $Kg/m^3$.

21. A system according to claims wherein said inner side surfaces of said first and second sidewalls are inclined upwardly and outwardly at an angle of 3 to 10° from a vertical axis.

22. A system according to claim 14, wherein said first and second protecting portions and said spacer portion of each of said plurality of spacers define an opening through which said support material is introduced into said plurality of building blocks.

23. A system according to claim 14, wherein a bottom opening is defined between said inner side surfaces of said first and second sidewalls and between each adjacent pair of said first plurality of spacers in each of said plurality of building blocks, and said support material includes a plurality of reinforcing rods vertically positioned through said plurality of building blocks via bottom openings in each of said plurality of building blocks.

24. A system according to claim 14, wherein said support material includes insulation material filling said cavity in each of said plurality of building blocks.

25. A system according to claim 14, wherein said support material includes sound absorbing material filling said cavity in each of said plurality of building blocks.

26. A system according to claim 14, wherein said first and second protecting portions and said spacer portion of each of said plurality of spacers define an opening through which said support material is introduced into said plurality of building blocks.

27. A system according to claim 14, wherein said support material includes at least one of electrical conduits and wiring fed via said openings through said plurality of building blocks.

28. A system according to claim 14, wherein said support material includes fluid pipes fed via said openings through said plurality of building blocks.

* * * * *